US006641320B1

(12) United States Patent
Ballot et al.

(10) Patent No.: US 6,641,320 B1
(45) Date of Patent: Nov. 4, 2003

(54) APPLICATOR TIP FOR LIQUID APPLICATOR DEVICE

(76) Inventors: Richard W. Ballot, 345 Memorial Dr., Crystal Lake, IL (US) 60014; Stephan M. Ballot, 345 Memorial Dr., Crystal Lake, IL (US) 60014

( * ) Notice: Subject to any disclaimer, the term of this patent is extended or adjusted under 35 U.S.C. 154(b) by 0 days.

(21) Appl. No.: 09/693,767

(22) Filed: Oct. 20, 2000

Related U.S. Application Data

(60) Provisional application No. 60/160,915, filed on Oct. 22, 1999.

(51) Int. Cl.[7] ..... B43K 5/00

(52) U.S. Cl. ..... 401/206; 401/205; 401/198; 401/272; 401/270

(58) Field of Search ..... 401/264, 198, 401/199, 263, 205, 200, 270, 272

(56) References Cited

U.S. PATENT DOCUMENTS

| | | | | |
|---|---|---|---|---|
| 1,857,467 A | | 5/1932 | Marsh | |
| 2,024,413 A | | 12/1935 | Witt | |
| 2,210,662 A | | 8/1940 | Garvey | |
| 2,330,053 A | | 9/1943 | Herb | |
| 3,468,611 A | | 9/1969 | Ward | |
| 3,551,065 A | * | 12/1970 | Molin et al. | 401/199 |
| 4,685,820 A | | 8/1987 | Kremer et al. | |
| 4,792,252 A | | 12/1988 | Kremer et al. | |
| 4,848,947 A | | 7/1989 | Kremer et al. | |
| 4,976,564 A | | 12/1990 | Fukuoka et al. | |
| 4,984,923 A | | 1/1991 | Ota | |
| 4,993,859 A | | 2/1991 | Assad et al. | |
| 5,342,136 A | * | 8/1994 | Fukaim | 401/135 |
| 5,568,988 A | | 10/1996 | Knox et al. | |
| 6,059,477 A | * | 5/2000 | Dunlap, Jr. et al. | 401/199 |

* cited by examiner

*Primary Examiner*—David J. Walczak
(74) *Attorney, Agent, or Firm*—Frijouf, Rust & Pyle, P.A.

(57) ABSTRACT

A liquid applicator device comprising an applicator liquid container and a liquid dispensing mechanism. The device has a valve element movable disposed between an open position and a closed position for controlling the flow of the applicator liquid from the container. The liquid dispensing mechanism has a hollow cylindrical portion for supporting an applicator tip. The inner end of the applicator tip communicates with the valve element. An axial displacement of the applicator tip moves the valve element into the open position for enabling the applicator liquid to migrate through the applicator tip for applying the liquid to a surface. The improvement comprises a recess cooperating with a retainer for preventing the removal of the applicator tip from the liquid applicator device.

23 Claims, 15 Drawing Sheets

PRIOR ART

APPLICATOR TIP FOR LIQUID APPLICATOR DEVICE

CROSS-REFERENCE TO RELATED APPLICATIONS

This application claims benefit of U.S. Patent Provisional application Ser. No. 60/160,915 filed Oct. 22, 1999. All subject matter set forth in provisional application Ser. No. 60/160,915 is hereby incorporated by reference into the present application as if fully set forth herein.

BACKGROUND OF THE INVENTION

1. Field of the Invention

This invention relates to the dispensing of liquids and more particularly, this invention relates to an improved applicator device for marking, writing or dispensing a liquid on a surface.

2. Background of the Invention

Various types of liquid applicator devices have been devised for dispensing a liquid. Some of these liquid applicator devices were used for dispensing an applicator liquid for writing with ink, dye or paint. Among such devices were fountain pens, ball point pens, felt tip pens as well as other types of liquid applicator devices and the like.

These liquid applicator devices of the prior art have receiving wide acceptance due in great measure to the convenience of the device. Furthermore, these liquid applicator devices of the prior art had the ability to retain a large quantity of applicator liquid and the ability to supply additional applicator liquid from a liquid container to an applicator tip at the discretion of the user. In addition, the liquid applicator devices were not limited to the dispensing of only writing liquid such as paints, dyes and the like but are capable of dispensing a large variety of applicator liquids including chemicals, perfumes, lubricants and the like.

Continuing efforts have been made in the past to improve the design of the liquid applicator devices. The improve the design of the liquid applicator devices have concentrated on the liquid dispensing mechanism and for improving the communication of the liquid from the liquid container to the applicator tip for dispensing the applicator liquid onto a surface. In one example of a liquid applicator device, an applicator liquid flows into a fiber applicator tip only when the liquid applicator device is held upside down and the fiber applicator tip is depressed by a surface to be coated by the applicator liquid.

U.S. Pat. No. 1,857,467 to Marsh discloses a fountain marker comprising a main reservoir adapted to contain fluid with an end wall for said reservoir having an opening therethrough. An auxiliary reservoir is arranged to receive fluid through the opening with a valve opening and closing the discharge outlet. A stem connected to the valve extends through the opening. The fluid is admitted from the main reservoir to the auxiliary reservoir when the valve is closed and is prevented from flowing from the main reservoir to the auxiliary reservoir when the valve is in an open position. A spring holds the valve closed with an applicator tip attached to the valve.

U.S. Pat. No. 2,024,413 to Witt discloses a fountain brush comprising an elongated hollow handle forming a liquid reservoir. A cap is secured to the forward end of the handle having an elongated frusto-conical valve seat and a closure cap on the opposite end of the handle. An elongated conical valve is received in the valve seat. An inwardly projecting stem is formed on the rear end of the valve. An outwardly projecting shank is carried by the forward end of the valve. A cross-head on the stem having an ends is slidably engaged with the inner face of the hollow handle. A contractile coil spring is disposed about the stem having one end anchored to the stem and the other end being anchored in place between the forward cap and handle. A brush-head on the shank and a conical deflector formed on the brush-head are arranged in facing relation to the valve for receiving liquid therefrom.

U.S. Pat. No. 2,210,662 to Garvey discloses a writing instrument comprising a reservoir for the writing fluid and a valve tiltable in different directions to control the discharge of fluid from the reservoir. A tiltable tip holder is united with and extends from the tiltable valve with the tiltable tip holder having an internal screw thread. A writing tip is made of a yieldable absorbent material and is screwed into the internal thread to project from the lower end of the tip holder. The writing tip is adjustable longitudinally on the screw thread in response to rotary movements of the tip independently of the tip holder. A means limits the rotary movements of the tip holder and includes a tiltable abutment carried by and tiltable with the united valve and tip holder and a fixed abutment co-operating with the tiltable abutment.

U.S. Pat. No. 2,330,053 to Herb discloses a fountain applicator comprising a fluid containing reservoir and a marking nib and means operable by pressure on the nib in excess of that required for marking therewith for forcing fluid from the reservoir to the nib.

U.S. Pat. No. 3,468,611 to Ward discloses a liquid applicator having a tubular member of flexible side wall construction. A porous applicator nib and valve means control the flow of liquid from the tubular member to the applicator nib.

U.S. Pat. No. 4,976,564 to Fukuoka et al. discloses an implement for applying a liquid comprising a container having an opening at a front end and a front tube attached to the container forward end. A hollow accommodating member has a chamber in an interior and formed with a rearward communication hole and a forward communication hole for holding the chamber in communication with the interior of the container and the interior of the front tube respectively. A liquid feed member is accommodated in the chamber and is movable axially thereof. A biased end valve is disposed inside the front tube to provide a liquid retaining portion inside the front tube around the end valve for closing the forward end opening of the front tube. An applicator having a capillary action extends through the forward end opening of the front tube and is secured to the front end of the end valve.

U.S. Pat. No. 4,984,923 to Ota discloses an operating member inserted in the middle cylinder to be movable backward and forward in the axial direction. A valve mechanism is provided in the front portion of the middle cylinder to supply the pinpoint with the applied liquid stored in the rear portion of the middle cylinder. The valve mechanism includes a valve seat having a valve hole with a valve spindle being provided with a valve element for opening and closing the valve hole and a stretchable member for moving the valve spindle backward and forward. The stretchable member is elongated and shortened in the axial direction of the middle cylinder as the bent portions of the bent arms are bent less and more, respectively. The operating element at the rear end of the middle cylinder is operated to move the operating member forward to push the bent portions of the bent arms to elongate the stretchable member. The valve spindle is moved backward to open the valve hole to supply the applied liquid to the pinpoint.

U.S. Pat. No. 4,993,859 to Assad et al. discloses a liquid applicator including a valve body for insertion into the neck of a liquid container and defining a duct in the valve body. A resilient web is formed integrally with the valve body and extends transversely across the duct. A valve seat is located on one end of the valve body. A valve member is secured to the resilient web and has a valve biased into engagement with the valve seat at the end of the valve body. A coating member is mounted on the opposite end of the valve body. A valve stem on the valve member is located proximate the coating member for being deflected when the coating member is compressed onto an external surface to thereby unseat the valve and permit liquid to flow through the duct onto the coating member.

U.S. Pat. No. 4,685,820 to Kremer et. al. discloses an improved applicator device for applying an applicator material such as a liquid or a flowable solid to a surface. The device comprises a material container and a surface applicator for applying the applicator material to the surface. A valve is interposed between the material container and the surface applicator to permit the flow of applicator material to the surface applicator when the valve is in an open position and to inhibit the flow of applicator material to the surface applicator when the valve is in a closed position. The valve includes a valve closure having an internal closure cavity with a first end being connected to the material container and with a second end defining a surface applicator opening therein. The valve element has a distal end portion that extends through the applicator opening of the valve closure when the valve element is biased into the closed position. The surface applicator comprises the distal end portion of the valve element cooperating with the applicator opening when the distal end portion of the valve element is pressed against the surface thereby forming an annular opening for the flow of the applicator material to apply and disperse the applicator material on the surface. U.S. Pat. No. 4,685,820 to Kremer et. al. provided a significant step forward in the art of applicator devices.

Although the aforementioned U.S. Patents solved many of the problems of the prior art, other problems persisted in the use of liquid applicator devices of this type. A major problem in the design and the utilization of liquid applicator devices of this type involves the retention of the fiber tip in the hollow cylindrical closure of the outer subassembly. The designs generally utilized in prior art liquid applicators typically relied on retention of the fiber tip by friction, or by affixing the fiber tip onto a threaded screw extending from the applicator. These methods of affixing the fiber tip are deficient in that they tend to loosen and detach from the liquid applicator.

Therefore, it is an object of the present invention is to provide an improved applicator tip for a liquid applicator device that ensures the improved applicator tip is retained within the liquid dispensing device.

Another object of the present invention is to provide an improved applicator tip for a liquid applicator device having a retainer for preventing removal of the applicator tip from the liquid applicator device.

Another object of the present invention is to provide an improved applicator tip for a liquid applicator device wherein the applicator tip may be utilized without altering the dispensing mechanism of the prior art.

Another object of the present invention is to provide an improved applicator tip for a liquid applicator device which does not appreciably increase the cost of the dispensing mechanism of liquid applicator device.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The present invention is defined by the appended claims with the specific embodiments shown in the attached drawings. For the purpose of summarizing the invention, the invention may be incorporated into an apparatus comprising a liquid dispensing device for the dispensing of an applicator liquid from a container to an applicator tip of the liquid dispensing device through the depression of the applicator tip. The liquid applicator device comprises an applicator liquid container and a liquid dispensing mechanism. The device has a valve element that is movable between an open position and a closed position for controlling the flow of applicator liquid from the container. The liquid dispensing mechanism having a support portion for supporting an applicator tip. The inner end of the applicator tip communicates with the valve element for permitting the flow of the applicator liquid from the container to the inner end of the applicator tip upon an axial displacement of the applicator tip. This axial displacement moves the valve element into the open position for enabling the applicator liquid to migrate to an outer end of the applicator tip for applying the liquid to a surface. The improvement comprises a recess cooperating with a retainer for preventing removal of the applicator tip from the liquid applicator device.

In one embodiment of the invention, the recess is defined in the applicator tip with the retainer cooperating with the support portion. In an alternate embodiment of the invention, the recess is defined in the support portion with the retainer cooperating with the applicator tip. In another embodiment of the invention, the recess is defined in the support portion with the retainer extending from the applicator tip. In still a further embodiment of the invention, the recess is defined in the applicator tip with the retainer extending from the support portion.

In one specific example of the invention, the recess comprises an annular recess disposed in the applicator tip. The retainer comprises a retaining ring disposed in the annular recess of the applicator tip for forming an interference fit with the support portion for preventing removal of the applicator tip from the liquid applicator device.

In another specific example of the invention, the recess comprises an annular recess disposed in proximately to the support portion. The retainer comprises a retaining ring projected from the applicator tip and located between the outer end and the inner end thereof for forming an interference fit for preventing removal of the applicator tip from the liquid applicator device.

In still another specific example of the invention, the recess comprises an annular recess disposed in the applicator tip. The retainer projects from the support portion into the annular recess for forming an interference fit for preventing removal of the applicator tip from the liquid applicator device.

In another embodiment of the invention, a shoulder is disposed on the support portion for receiving the retaining ring disposed in the annular recess of the applicator tip. In one embodiment of the invention, the applicator tip comprises a substantially flexible applicator tip and in an alternate embodiment, the applicator tip comprises a substantially rigid applicator tip. In another embodiment of the invention, the inner end of the applicator tip comprises a tapered portion for facilitating the flow of liquid to the inner end of the applicator tip.

In a more specific embodiment of the invention, the applicator tip is made from a porous material for enabling the liquid to migrate from the inner end to the outer end of the applicator tip for applying the liquid to the surface. The applicator tip is a substantially cylindrical applicator tip having a first diameter and with the annular recess having a second diameter. The annular recess is disposed between the outer end and the inner end.

In one specific embodiment of the invention, the annular recess extends along at least one-quarter of a cylindrical length of the cylindrical applicator tip. The retaining ring has an inner diameter greater than the second diameter of the annular recess and less than the first diameter of the cylindrical applicator tip enabling the retaining ring to be slidably retained within the annular recess. The retaining ring has an outer diameter greater than the first diameter of the cylindrical applicator tip for engaging a shoulder disposed on the hollow cylindrical portion. The applicator tip is thus prevented from removal from the liquid applicator device.

The retaining ring disposed in the annular recess of the applicator tip may be made of a metallic material or may be made of a polymeric material. Preferably, the applicator liquid dispensing mechanism and the valve element are comprised of a plastic material.

The improvement comprises an applicator tip having an annular recess disposed between the outer end and the inner end. A retaining ring is disposed in the annular recess of the applicator tip. The support portion has a shoulder disposed thereon for receiving the retaining ring disposed on the applicator tip. An outer assembly is securable to an inner assembly for entrapping the retaining ring disposed in the annular recess between the outer and the inner assemblies for preventing the removal of the applicator tip from the liquid applicator device.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
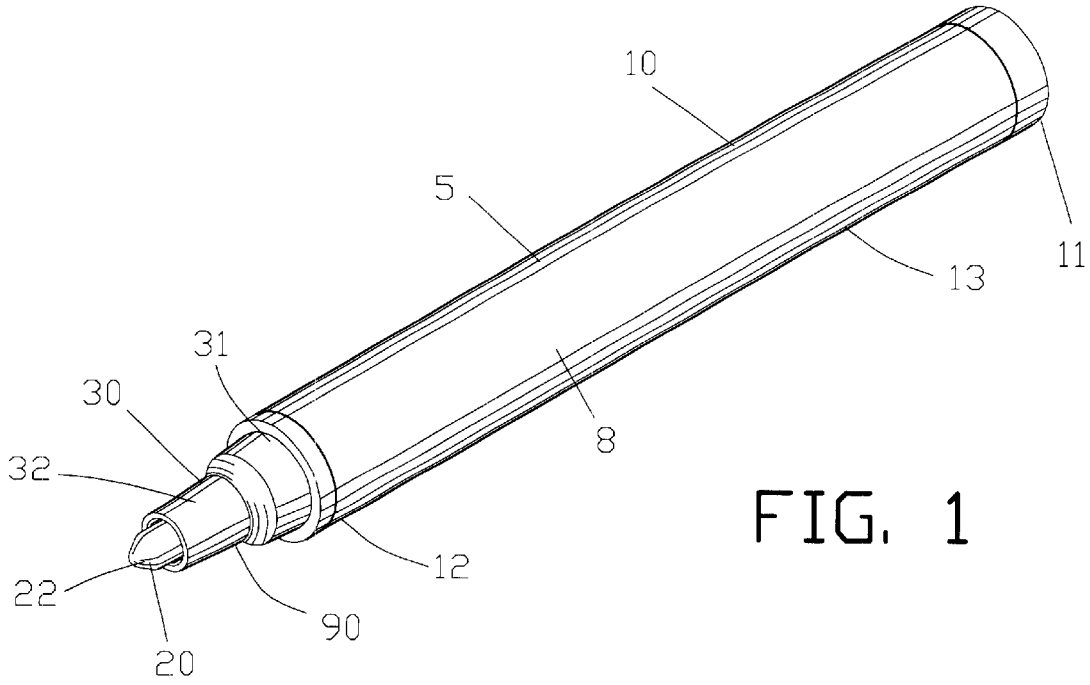
FIG. 1 is an isometric view of a liquid applicator device.

FIG. 1 illustrates a liquid applicator device 5 for dispensing an applicator liquid 8 from a container 10. The liquid applicator device 5 comprises an applicator tip 20 for dispensing the applicator liquid 8 from the container 10 onto the surface (not shown) by a dispensing mechanism 30. As will be described in greater detail hereinafter, the applicator tip 20 is used to dispense the applicator liquid 8 from the container 10 onto the surface upon the depression of the applicator tip 20 by the applicator surface. The applicator tip 20 may be covered by a protective overcap (not shown) for preventing accidental dispensing of the applicator liquid 8.

Figure 2:
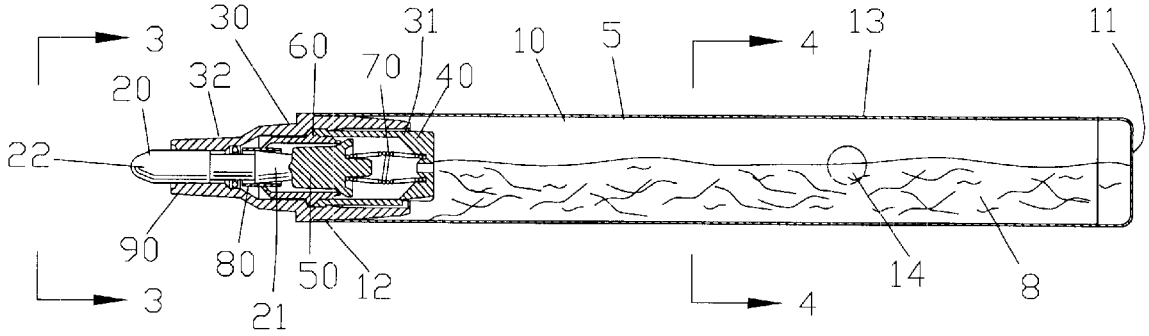
FIG. 2 is a sectional view of the liquid applicator device of FIG 1.
Figure 3:
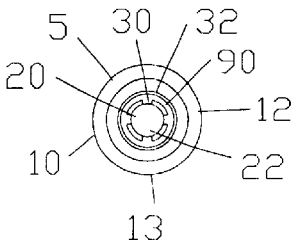
FIG. 3 is a view along line 3—3 in FIG. 2.
Figure 4:
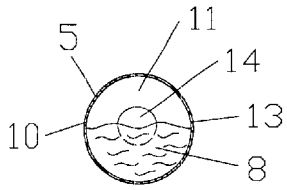
FIG. 4 is a sectional view along line 4—4 in FIG. 2.

FIGS. 2–4 are various views of the liquid applicator device 5 of FIG. 1. The container 10 is preferably formed in a cylindrical shape having a closed end 11, an open end 12 and a cylindrical side wall 13. The open end 12 is adapted to introduce a quantity of the applicator liquid 8 into the container 10. The applicator liquid 8 may be a marking liquid, a lubricating liquid or any other type of liquid suitable for being dispensed by the applicator tip 20.

When the liquid applicator device 5 is used to apply a marking liquid 8, the marking liquid 8 may be formed of opaque particles suspended in a carrier material as should be well known in the art. In the event that a liquid suspension is used for the applicator liquid 8, the liquid applicator device 5 will preferably include an agitator 14 shown as a ball or a metal slug disposed within the liquid container 10. The purpose of the ball 14 is to disburse the suspended particles of the applicator liquid 8 throughout the carrier fluid in the event that the suspended particles have become precipitated or settled from the carrier through non-use over a period of time. A preferable material for the ball 14 is a metallic material selected to minimize any chemical reaction with the applicator liquid 8. The ball 14 is preferably of a diameter sufficiently smaller than the inside diameter of the container 10 and of a specific gravity significantly greater than the applicator liquid 8 whereby shaking of the container 10 will readily move the ball 14 to effect the dispersion of the suspended particles throughout the carrier fluid to improve the performance of the liquid applicator device 5.

The applicator tip 20 is a generally cylindrically shaped member extending from an inner end 21 to an outer end 22. The applicator tip 20 may formed from a felt fiber or a brush construction. The applicator tip 20 may be rigid or flexible.

In this example of the invention, the applicator tip 20 is formed of a highly compacted fibrous material such as polyester or other similar material having analogous properties sufficient to hold the original shape when moistened with the applicator liquid 8 but adequate to pass the applicator liquid 8 from the inner end 21 to the outer end of the applicator tip 20 by capillary action.

The dispensing mechanism 30 includes an inner subassembly 31 and an outer subassembly 32. The inner subassembly 31 includes a valve body 40, a valve element 50, a valve seal 60, a spring 70 and a tubular seal 80. The outer subassembly 32 includes a closure 90. The closure provides a support portion for positioning and slidably supporting the applicator tip 20.

Figure 5:
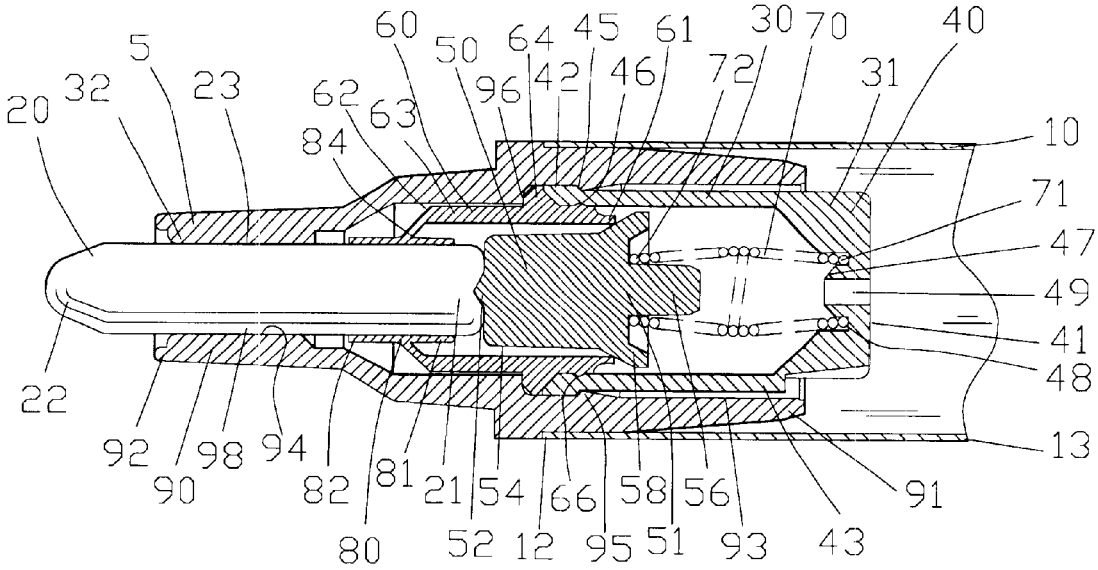
FIG. 5 PRIOR ART
FIG. 5 is an enlarged view of a portion of FIG. 2 illustrating a prior art applicator tip within a liquid dispensing mechanism in a closed position.

FIG. 5 is an enlarged sectional view of a prior art liquid dispensing mechanism 30 in a closed position. The valve body 40 is defined by a valve body inner end 41 and a valve body outer end 42. The valve body inner end 41 comprises a solid face whereas the valve body outer end 42 comprises an opening. A cylindrical side wall 43 extends between the valve body inner end 41 and the valve body outer end 42.

A valve body shoulder 45 is formed on the valve body outer end 42 of the valve body 40. The valve body shoulder 45 is used for affixing the valve body 40 to the closure 90 as will be described in greater detail hereinafter.

A valve body hollow 46 is defined within an inside surface of the cylindrical side wall 43. The valve body hollow 46 is used for affixing the valve body 40 to the valve seal 60 as will be described in greater detail hereinafter.

A valve body projection 47 extends from the valve body inner end 41 of the valve body 40. A circular recess 48 is defined within the valve body inner end 41 of the valve body 40 and encircles the valve body projection 47. The valve body projection 47 and the circular recess 48 cooperate to receive a first end 71 of the spring 70.

The valve body 40 is provided with a hole 49 defined within the valve body inner end 41 of the valve body 40. The hole 49 defined within the valve body 40 facilitates the flow of the applicator liquid 8 from the inside surface of the container 10 into the valve body 40.

The valve element 50 extends between a valve element inner end 51 and a valve element outer end 52. The valve element 50 defines a circumferential side wall 54. A valve element projection 56 extends from the valve element inner end 51 of the valve element 50. The valve element projection 56 receives a second end 72 of the spring 70.

The circumferential side wall 54 of the valve element 50 supports a flared peripheral shoulder 58. The outside diameter of the flared peripheral shoulder 58 is less than the inner diameter of the valve body 40 for enabling the valve element 50 to move within the valve body 40.

The valve seal 60 includes a valve seal inner end 61 and a valve seal outer end 62 with a cylindrical sidewall 63 extending therebetween. The cylindrical side wall 63 is provided with a valve seal shoulder 64. The valve seal shoulder 64 is shown as a circumferential shoulder having a diameter greater than the remainder of the cylindrical side wall 63 of the valve seal 60. The valve seal shoulder 64 has a diameter substantially the same diameter as the diameter of the valve body 40.

The valve seal 60 includes a valve seal annular bulge 66 extending about an outer surface of the cylindrical side wall 63. The valve seal annular bulge 66 cooperates with the valve body hollow 46 of the valve body 40 for affixing the valve body 40 to the valve seal 60 as will be described in greater detail hereinafter.

The valve seal 60 may be press fit into the valve body 40 with the valve element 50 and the spring 70 located therebetween. The valve seal shoulder 64 limits the depth of penetration of the valve seal 60 into the valve body 40. The valve body hollow 46 of the valve body 40 receives the valve seal annular bulge 66 of the valve seal 60 for interlocking the valve seal 60 within the valve body 40 and for forming the inner subassembly 31 for the dispenser mechanism 30.

The outside diameter of the flared peripheral shoulder 58 of the valve element 50 is less than the inner diameter of the valve body 40 enabling the valve element 50 to move within the valve body 40. The outside diameter of the flared peripheral shoulder 58 of the valve element 50 is greater than the inner diameter of the valve seal inner end 61 of the valve seal 60 for enabling valve element 50 to form a seal with the valve seal 60.

The spring 70 biases the dispensing mechanism 30 in a closed condition as shown in FIG. 5. The flared peripheral shoulder 58 of the valve element 50 is biased into engagement with the valve seal inner end 61 of the valve seal 60 by the spring 70 to prevent the passage of the applicator liquid 8. The spring 70 is preferably formed of stainless steel or other similar material to preclude or minimize chemical reaction with the applicator liquid 8.

A tubular seal 80 extends between a tubular seal inner end 81 and a tubular seal outer end 82. An intermediate mounting 84 integrally secures the tubular seal 80 to the valve seal outer end 62 of the valve seal 60. The tubular seal 80 provides a sliding seal with the applicator tip 20;

The applicator tip 20 extends between the inner end 21 and the outer end 22 and defines a cylindrical diameter 23 between the inner end 21 and the outer end 22. The inner end 21 of the applicator tip 20 is in direct engagement with the valve element outer end 52 of the valve element 50. The cylindrical diameter 23 of the applicator tip 20 forms a sliding seal with the tubular seal 80.

The closure 90 extends between a closure inner end 91 and a closure outer end 92. The closure inner end 91 of the closure is open for receiving a portion of the inner subassembly 31 within an internal tapered region 93 of the closure 90. The internal tapered region 93 communicates with a passageway 94 extending to the closure outer end 92 of the closure 90.

The internal tapered region 93 of the closure 90 includes a closure annular ring 95 extending inwardly from the internal tapered region 93 of the closure 90. The internal tapered region 93 of the closure 90 includes a closure shoulder 96 for cooperating with the valve seal shoulder 64 of the valve seal 60.

The closure 90 has support centering ribs 98 extending from the inner surface of the passageway 94. The support centering ribs 98 frictionally engages and supports the applicator tip 20. The support centering ribs 98 support the applicator tip 20 in a sliding engagement for enabling axial movement of the applicator tip 20 relative to the closure 90.

The internal tapered region 93 of the closure 90 receives a portion of the inner subassembly 31 with the valve seal shoulder 64 engaging the closure shoulder 96. The closure annular ring 95 of the closure 90 engages with the valve body shoulder 45 of the valve body 40 for interlocking the valve body 40 to the closure 90 thereby joining the inner subassembly 31 to the outer subassembly 32.

The applicator tip 20 is supported by support centering ribs 98 of the closure 90 and extends through the tubular seal 80. The inner end 21 of the applicator tip 20 engages the outer end 52 of the valve element 50 whereas the outer end 22 of the applicator tip 20 extends from the closure 90.

The dispensing mechanism 30 may be joined to the container 10 by a press fit engagement. The closure 90 is tapered to be press fit inside the open end 12 of the container 10.

Figure 6:
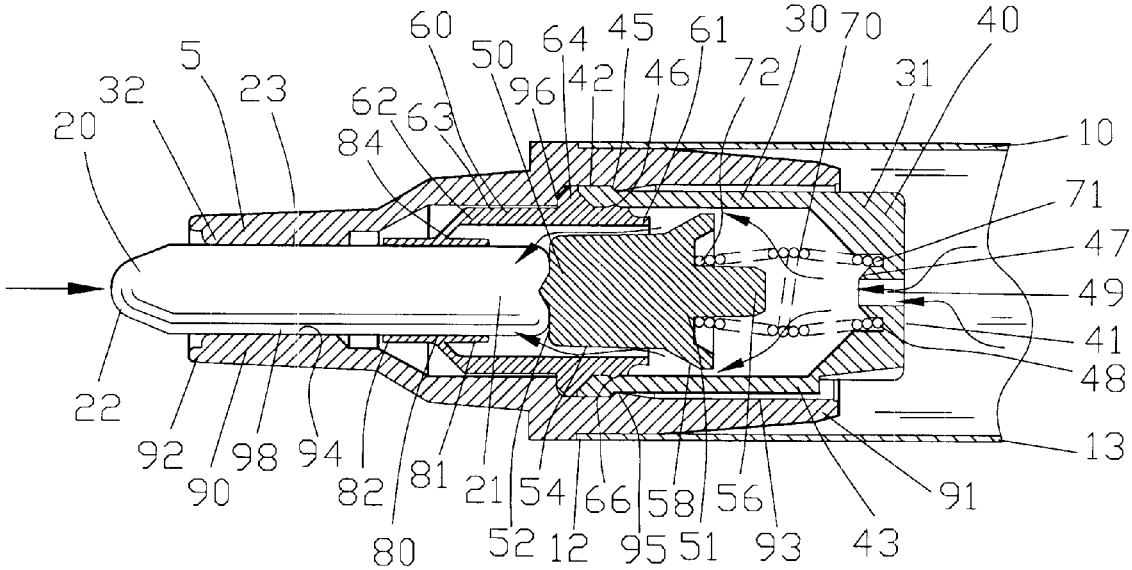
FIG. 6 is a view similar to FIG. 5 illustrating the prior art applicator tip in the liquid dispensing mechanism in an open position.

FIG. 6 is an enlarged sectional view similar to FIG, 5 illustrating the prior art liquid dispensing mechanism 30 in an open position. A depression of the applicator tip 20 against a surface (not shown) will compress the spring 70 and move the valve element 50 inwardly from the valve seal 60 to move the dispensing mechanism 30 in the open condition. The flared peripheral shoulder 58 of the valve element 50 is separated from the valve seal inner end 61 of the valve seal 60 for enabling the passage of the applicator liquid 8 from the container 10 to contact the inner end 21 of the applicator tip 20. The applicator liquid 8 moves from the inner end 21 to the outer end 22 of the applicator tip 20 by capillary action.

When pressure is applied as through the depression of the applicator tip 20, the inner end 21 of the applicator tip 20 is replenished with the applicator liquid 8. The applicator liquid 8 moves by capillary action from the inner end 21 to the outer end 22 of the applicator tip 20. The applicator liquid 8 at the outer end 22 of the applicator tip 20 may be transferred to a surface by marking, dabbing or a brushing action.

The applicator device 5 of the prior art shown in FIGS. 5 and 6 operated satisfactory for a wide majority of uses. However, in a small minority of uses, the applicator tip 20 could be inadvertently withdrawn from the passageway 94 of the closure 90. In some instances, the applicator tip 20 was caught on an imperfection such as a metal flashing extending from the surface (not shown) to receive the applicator liquid 8. In other instances, the applicator liquid 8 formed a bond between the surface to receive the applicator liquid 8 and the outer end 22 of the applicator tip 20. Upon moving the applicator device 5 away from the surface, the applicator tip 20 was withdrawn from the passageway 94 of the closure 90. In addition, the possibility of the withdrawal of the applicator tip 20 from the passageway 94 of the closure 90 made the applicator device 5 of the prior art totally unsuitable for use by children. Since the applicator tip 20 could be removed from the applicator device 5, a child could ingest the applicator tip 20 possibly causing sever discomfort or injury to the child. The present invention overcomes this deficiency and positively retains the applicator tip within the applicator device.

Figure 7:
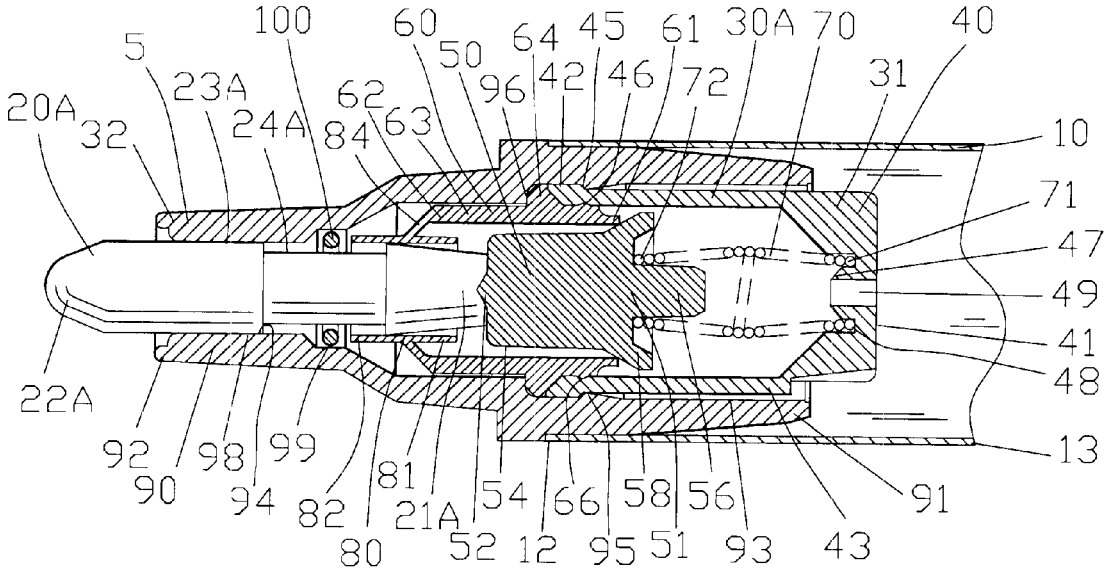
FIG. 7 is an enlarged view of a portion of FIG. 2 illustrating a first embodiment of a applicator tip of the present invention incorporated into the liquid dispensing mechanism shown disposed in a closed position.
Figure 8:
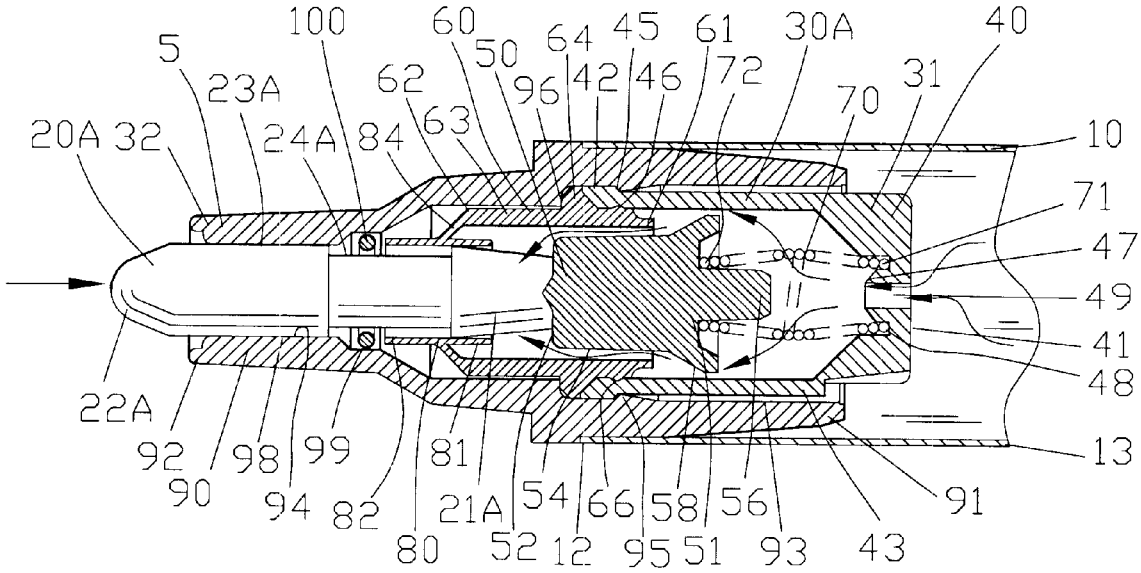
FIG. 8 is a view similar to FIG. 7 illustrating the liquid dispensing mechanism in an open position.

FIGS. 7 and 8 are views similar to FIGS. 5 and 6 of the liquid dispensing mechanism 30 incorporating the improved applicator tip 20A of the present invention. The dispensing mechanism 30 is shown in the closed position and the open position in FIGS. 7 and 8, respectively. The liquid dispensing mechanism 30 incorporates most of the components of the liquid dispensing mechanism 30 of the prior art shown in FIG. 5 which are identified by the same reference numeral.

The applicator tip 20A extends between the inner end 21A and the outer end 22A and defines a cylindrical diameter 23A. In this example the applicator tip 20A is formed of a highly compacted fibrous material having properties sufficient to hold the original shape when moistened with the applicator liquid 8 and being compressible. The inner end 21A of the applicator tip 20A is in direct engagement with the valve element outer end 52 of the valve element 50. The cylindrical diameter 23A of the applicator tip 20A forms a sliding seal with the tubular seal 80. The cylindrical diameter 23A of the applicator tip 20A is supported in a sliding engagement by the support centering ribs 98 extending from the closure 90 for enabling axial movement of the applicator tip 20A relative to the closure 90. The applicator tip 20A includes an annular recess 24A located intermediate the inner end 21A and the outer end 22A of the applicator tip 20A. A retaining ring 100 is located within the annular recess 24A.

Figure 9:
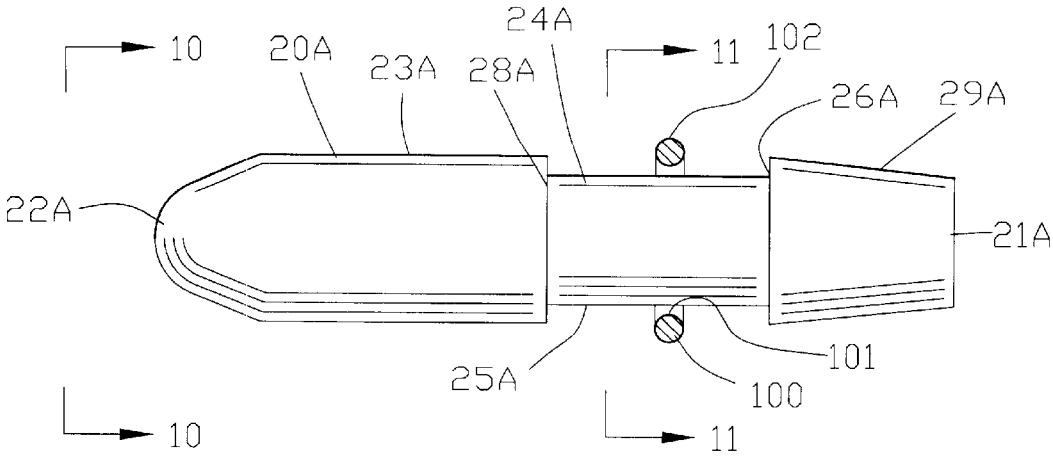
FIG. 9 is a magnified side view of the applicator tip and the retainer shown in FIGS. 7 and 8.
Figure 10:
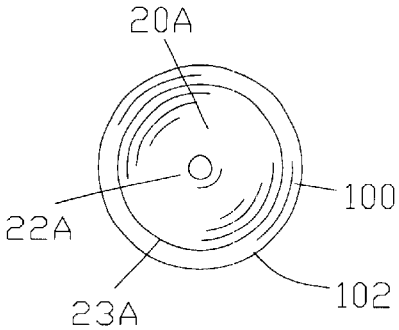
FIG. 10 is a view along line 10–13 in FIG. 9.
Figure 11:
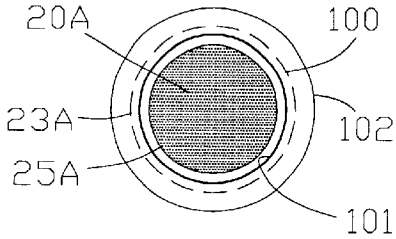
FIG. 11 is a sectional view along line 11—11 in FIG. 9.

FIGS. 9–11 are magnified views of the applicator tip 20A and the retaining ring 100 of FIGS. 7 and 8. The annular recess 24A defines a recess diameter 25A extending between an inner shoulder 26A and an outer shoulder 28A. The cylindrical diameter 23A of the applicator tip 20A is greater than the recess diameter 25A of the annular recess 24A. The annular recess 24A extending along at least one-quarter of a cylindrical length of the applicator tip 20A. The inner end 21A of the applicator tip 20A may include an optional taper 29A as shown in FIGS. 7 and 9. The optional taper 29A of the inner end 21A of the applicator tip 20A facilitates the flow of applicator liquid 8 to the inner end 21A of the applicator tip 20A.

The retaining ring 100 is inserted into the annular recess 24A of the applicator tip 20A by compressing the inner end 21A of the applicator tip 20A. The optional taper 29A of the inner end 21A of the applicator tip 20A facilitates the insertion of the retaining ring 100 into the annular recess 24A of the applicator tip 20A. The applicator tip 20A may be compressed by a suitable compression tool or may be compressed by the movement of the retaining ring 100. The retaining ring 100 is passed over the compressed cylindrical diameter 23A of the inner end 21A of the applicator tip 20A. After the retaining ring 100 is passed over the compressed cylindrical diameter 23A of the applicator tip 20A, the compressed cylindrical diameter 23A returns to the original cylindrical diameter 23A. After the retaining ring 100 is inserted into the annular recess 24A of the applicator tip 20A, the applicator tip 20A is inserted into the passageway 94 of the closure 90.

As best shown in FIGS. 9 and 11, the retaining ring 100 has an inner diameter 101 greater than the diameter 25A of the annular recess 24A and less than the cylindrical diameter 23A of the applicator tip 20A. The above selection of the inner diameter 101 of the retaining ring 100 enables the retaining ring 100 to be slidably retained within the annular recess 24A.

The retaining ring 100 has an outer diameter 102 greater than the cylindrical diameter 23A of the applicator tip 20A. The outer diameter 102 of the retaining ring 100 cooperates with the closure 90 for preventing removal of the applicator tip 20A from the dispensing mechanism 30. Preferably, retaining ring 100 is fabricated of a metallic material, such as stainless steel or the like.

Figure 12:
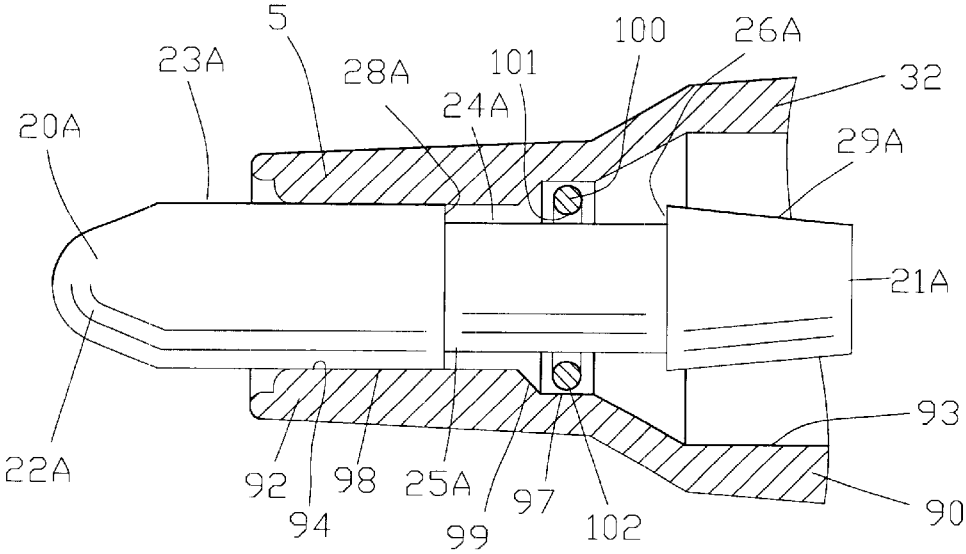
FIG. 12 is a magnified view of a portion of FIG. 7.

FIG. 12 is a magnified view of a portion of FIG. 7. The closure 90 includes a hollow cylindrical respite 97 located adjacent to a shoulder 99 defined by the termination of the support centering ribs 98 of the closure 90.

The hollow cylindrical respite 97 is dimensioned to receive the retaining ring 100 therein. The retaining ring 100 has an outer diameter 102 greater than the diameter of the shoulder 99 defined by the support centering ribs 98 of the closure 90. Accordingly, the retaining ring 100 forms an interference fit with shoulder 99 for preventing removal of the applicator tip 20A from the a liquid applicator device 5.

Figure 13:
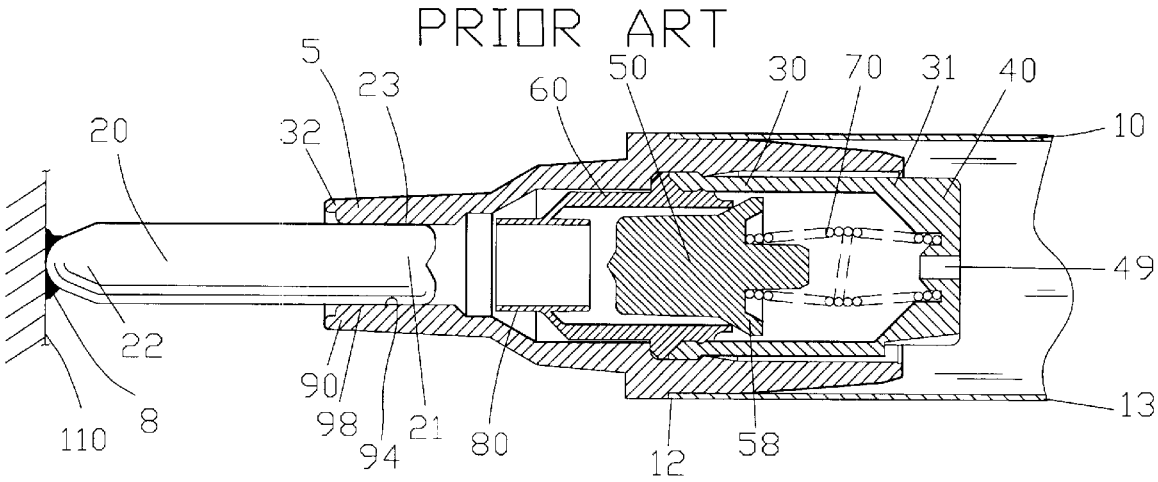
FIG. 13 is a view similar to FIG. 5 illustrating the detachment of the prior art applicator tip from the liquid dispensing mechanism.

FIG. 13 is a view similar to FIGS. 5 and 6 illustrating the detachment of the prior art applicator tip 20 from the liquid dispensing mechanism 30. The prior art applicator tip 20 is used to dispense the applicator liquid 8 from the container 10 onto the surface 110 upon the depression of the applicator tip 20 by the surface 110. In a small minority of uses, the applicator liquid 8 stuck to the surface 110 receiving the applicator liquid 8 and the outer end 22 of the applicator tip 20. Upon moving the applicator device 5 away from the surface 110, the applicator tip 20 was withdrawn from the passageway 94 of the closure 90 as shown in FIG. 13.

Figure 14:
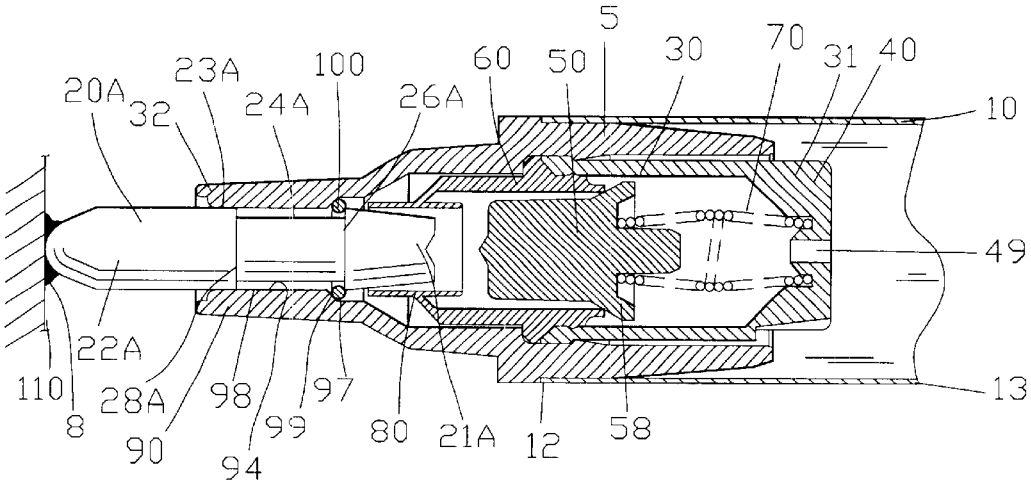
FIG. 14 is a view similar to FIG. 7 illustrating the retention of the applicator tip of the present invention within the liquid dispensing mechanism.

FIG. 14 is a view similar to FIGS. 7 and 8 illustrating the retention of the improved applicator tip 20A of the present invention by the liquid dispensing mechanism 30. In the event the applicator liquid 8 sticks to the surface 110 receiving the applicator liquid 8 and the outer end 22A of the applicator tip 20A, the retainer comprising the retaining ring 100 prevents removal of the applicator tip 20A from the liquid dispensing mechanism 30.

Upon moving the applicator device 5 away from the surface 110, the applicator tip 20A moves outwardly until the retainer ring 100 engages with the inner shoulder 26A simultaneously with the retainer ring 100 engaging with the shoulder 99 of the closure 90.

The retainer ring 100 engaging with the inner shoulder 26A simultaneously with the retainer ring 100 engaging with the shoulder 99 of the closure 90 prevents removal of the applicator tip 20A from the liquid applicator device 5.

Figure 15:
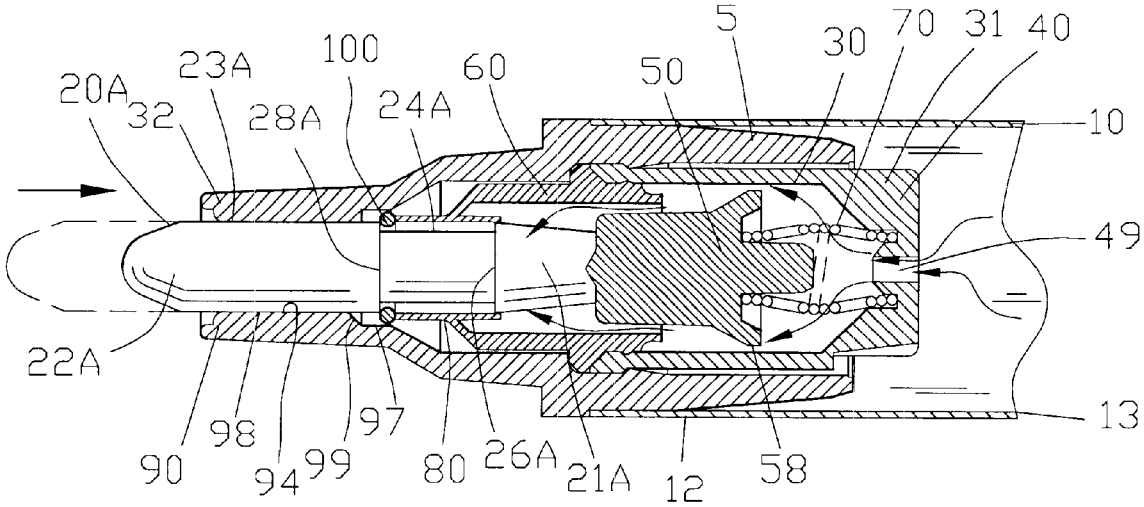
FIG. 15 is a view similar to FIG. 14 with the liquid dispensing mechanism in an open position.

FIG. 15 is a view similar to FIG. 14 of the applicator tip 20A of the present invention within the liquid dispensing mechanism 30 in an open position. The position of the applicator tip 20A is shown in phantom when the liquid dispensing mechanism 30 is in the closed position. The applicator tip 20A extends between the inner end 21A and the outer end 22A with the annular recess 24A located therebetween. The annular recess 24A extends between the inner shoulder 26A and the outer shoulder 28A. In the first embodiment of the present invention, the annular recess 24A extends along approximately one-quarter of a cylindrical length of the applicator tip 20A.

Figure 16:
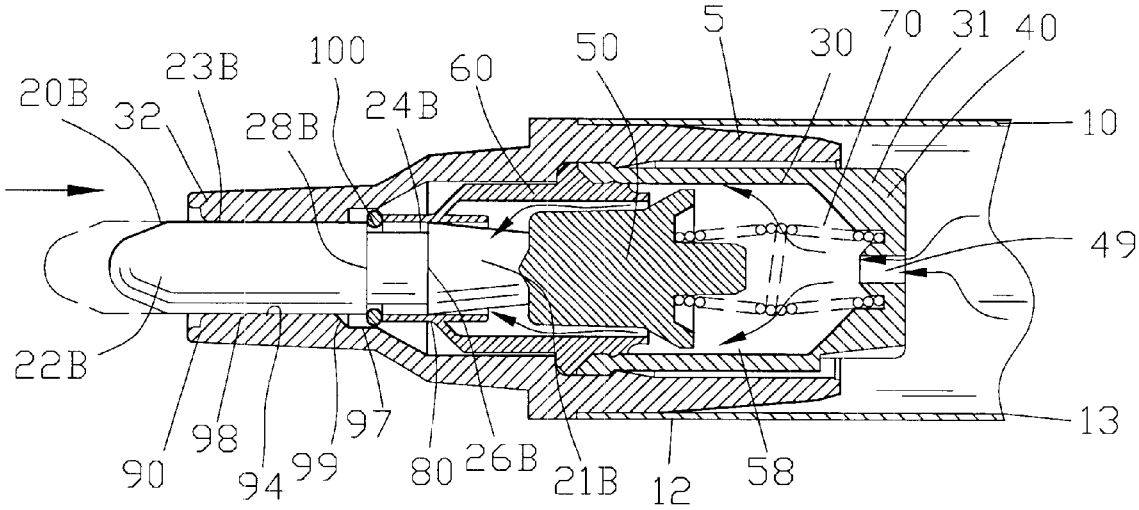
FIG. 16 is a view similar to FIG. 15 illustrating a second embodiment of an applicator tip of the present invention having a recess with a reduced longitudinally extending length.

FIG. 16 is a view similar to FIG. 15 illustrating a second embodiment of an applicator tip 20B of the present invention within the liquid dispensing mechanism 30 in an open position. The position of the applicator tip 20B is shown in phantom when the liquid dispensing mechanism 30 is in the closed position. The applicator tip 20B extends between the inner end 21B and the outer end 22B with the annular recess 24B located therebetween. The annular recess 24B extends between the inner shoulder 26B and the outer shoulder 28B. In the second embodiment of the present invention, the annular recess 24B extends along approximately one-eighth of a cylindrical length of the applicator tip 20B.

The solid and phantom lines of the applicator tip 20A in FIG. 15 illustrates the positions of the applicator tip 20A when the liquid dispensing mechanism 30 is in the open and closed position, respectively. The difference in positions illustrates the movement of the applicator tip 20A during the operation of the liquid dispensing mechanism 30.

The solid and phantom lines of the applicator tip 20B in FIG. 16 illustrates the positions of the applicator tip 20B when the liquid dispensing mechanism 30 is in the open and closed position, respectively. The difference in positions illustrates the movement of the applicator tip 20B during the operation of the liquid dispensing mechanism 30.

The reduction of the length of the annular recess 24B in the second embodiment relative to the annular recess 24A in the first embodiment reduces the distance of movement of the applicator tip 20A during the operation of the liquid dispensing mechanism 30. The present invention is able to alter the distance of movement of the applicator tip 20A during the operation of the liquid dispensing mechanism 30 by altering the length of the annular recess 24B.

Figure 17:
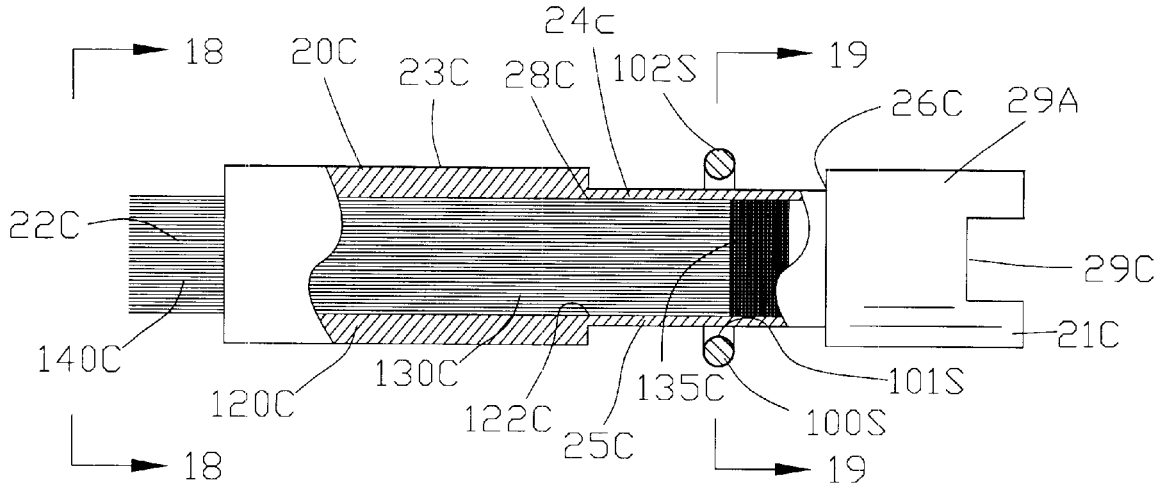
FIG. 17 is a magnified side view of a third embodiment of the applicator tip and the retainer of present invention.
Figure 18:
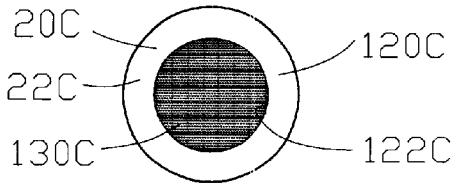
FIG. 18 is a view along line 18—18 in FIG. 17.
Figure 19:
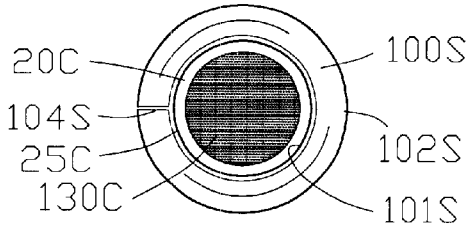
FIG. 19 is a view along line 19—19 in FIG. 17.

FIGS. 17–19 are magnified views of a third embodiment of the applicator tip 20C of present invention. The applicator tip 20C extends between the inner end 21C and the outer end 22C and defines a cylindrical diameter 23C. The applicator tip 20C includes an annular recess 24C located intermediate the inner end 21C and the outer end 22C of the applicator tip 20C. The annular recess 24C defines a recess diameter 25C extending between an inner shoulder 26C and an outer shoulder 28C. The cylindrical diameter 23C of the applicator tip 20C is greater than the recess diameter 25C of the annular recess 24C.

In this third embodiment of the invention, the applicator tip 20C comprises a sheath 120C having an internal passage 122C. Preferably, the sheath 120C is formed from a rigid or semi-rigid material such as a suitable polymeric material. The inner end 21C of the applicator tip 20C includes a plurality of voids 29C defined in the sheath 120C. The plurality of voids 29C facilitate the flow of applicator liquid 8 to the internal passage 122C of the applicator tip 20C.

A plurality of fibers 130C are disposed within the internal passage 122C for forming a brush 140C. The plurality of fibers 130C may be bound by a bonding 135C for facilitation insertion of the plurality of fibers 130C within the internal passage 122C of the sheath 120C. The plurality of fibers 130C may be secured within the internal passage 122C of the sheath 120C by friction, adhesives, sonic welding or any other suitable means.

In this third embodiment of the invention, the retaining ring 100S has an inner diameter 101S and an outer diameter 102S. The retaining ring 100S is an expandable ring having a split 104S. The inner diameter 101S is greater in diameter than the diameter 25C of the annular recess 24C and less than the cylindrical diameter 23C of the applicator tip 20C.

The retaining ring 100S is inserted into the annular recess 24C of the applicator tip 20C by expanding the retaining ring 100S to increase the inner diameter 101S. The retaining ring 100S may be expanded by a suitable expanding tool. The retaining ring 100S with the expanded the inner diameter 101S is passed over the cylindrical diameter 23C of the inner end 21C of the applicator tip 20C. When the retaining ring 100S is positioned over the annular recess 24C of the applicator tip 20C, the retaining ring 100S is released to allow the retaining ring 100S to return to the original diameter 101S.

Figure 20:
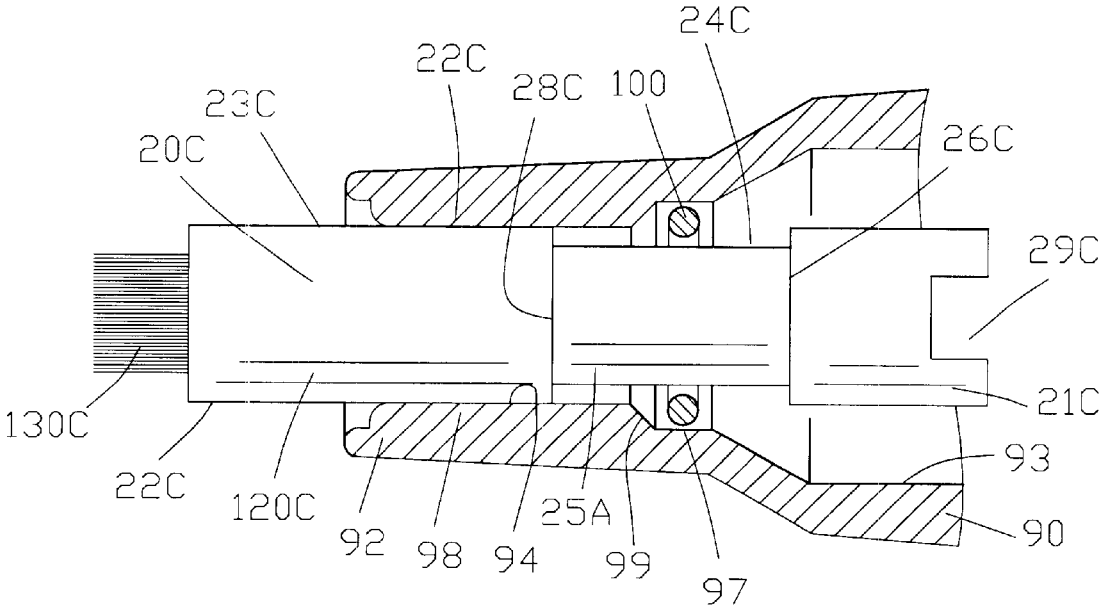
FIG. 20 is a magnified view of the retainer and applicator tip of FIG. 17 within the liquid dispensing mechanism.

FIG. 20 is a magnified view of the retainer and applicator tip of FIG. 17 within the liquid dispensing mechanism 30. The inner end 21C of the applicator tip 20C is in direct engagement with the valve element outer end 52 of the valve element 50. The cylindrical diameter 23C of the applicator tip 20C forms a sliding seal with the tubular seal 80. The cylindrical diameter 23C of the applicator tip 20C is supported in a sliding engagement by the support centering ribs 98 extending from the closure 90 for enabling axial movement of the applicator tip 20C relative to the closure 90.

Figure 21:
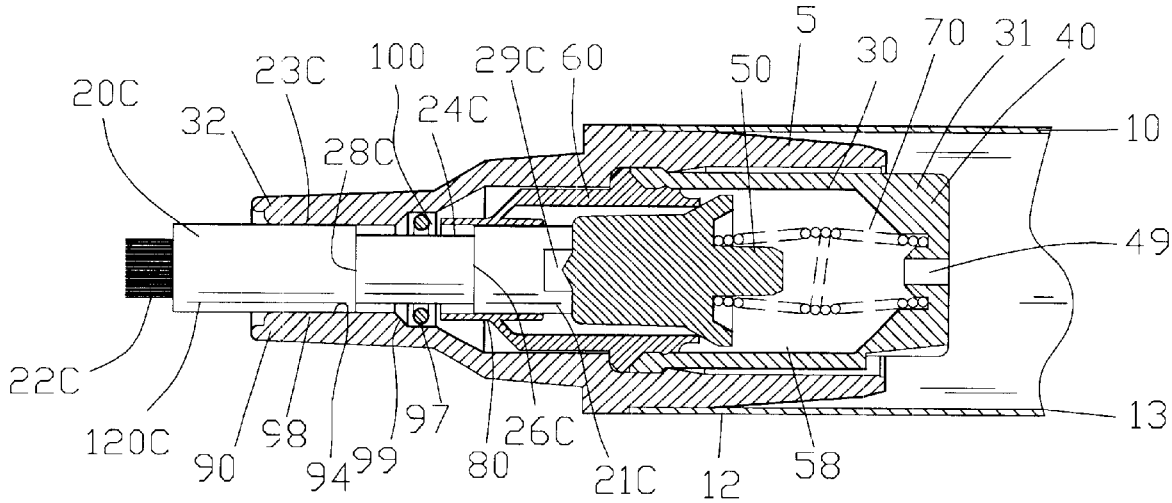
FIG. 21 is a side sectional view illustrating the third embodiment of an applicator tip of the present invention incorporating a small brush with the liquid dispensing mechanism being shown disposed in a closed position.

FIG. 21 is a side sectional view illustrating the third embodiment of the applicator tip 20C of the present invention incorporated within the liquid dispensing mechanism 30 being shown disposed in a closed position. The liquid dispensing mechanism 30 incorporates most of the components of the liquid dispensing mechanism 30 of the prior art shown in FIG. 5 which are identified by the same reference numeral.

Figure 22:
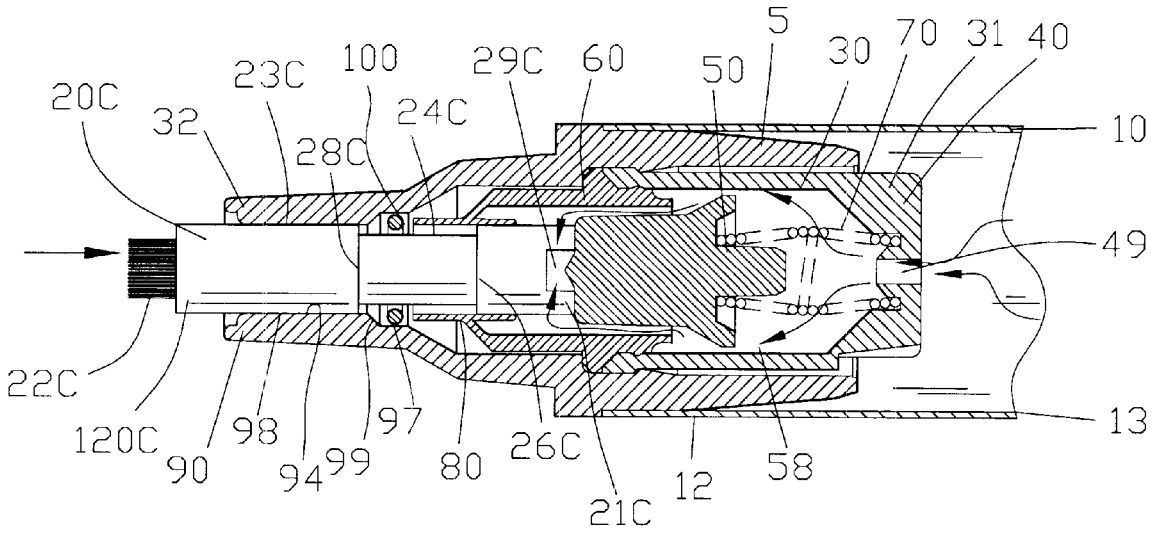
FIG. 22 is a view similar to FIG. 21 with the liquid dispensing mechanism being shown in an open position.

FIG. 22 is a view similar to FIG. 21 with the liquid dispensing mechanism 30 being shown in an open position. The liquid dispensing mechanism 30 is moved into the open position upon the depression of the applicator tip 20C by the surface 110. More specifically, the liquid dispensing mechanism 30 is moved into the open position upon the depression of the outer end 22C of the applicator tip 20C by the surface 110. The rigid or semi-rigid sheath 120C enables the dispensing mechanism 30 to be moved into the open position upon the depression of the outer end 22C of the applicator tip 20C.

Figure 23:
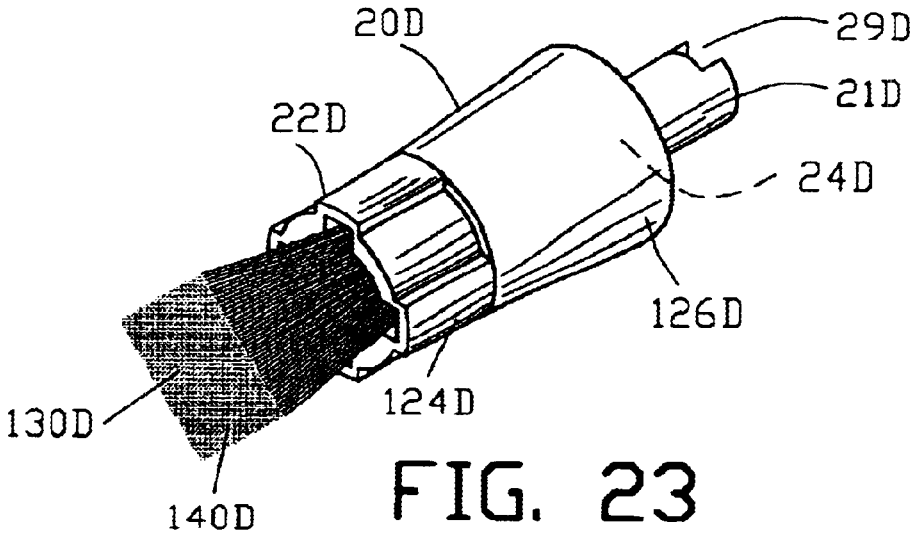
FIG. 23 is an enlarged isometric view of a fourth embodiment of an applicator tip of the present invention incorporating a major brush.
Figure 24:
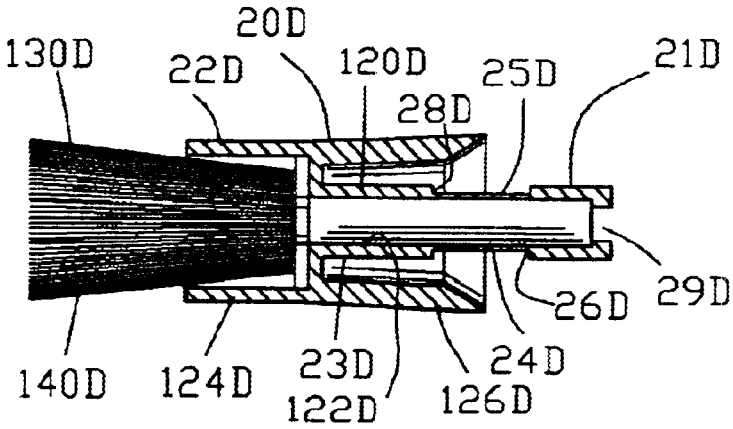
FIG. 24 is a side sectional view of FIG. 20.

FIGS. 23 and 24 are views of a fourth embodiment of an applicator tip 20D of the present invention. The applicator tip 20D extends between the inner end 21D and the outer end 22D and defines a cylindrical diameter 23D. The applicator tip 20D includes an annular recess 24D located intermediate the inner end 21D and the outer end 22D of the applicator tip 20D. The annular recess 24D defines a recess diameter 25D extending between an inner shoulder 26D and an outer shoulder 28D. The cylindrical diameter 23D of the applicator tip 20D is greater than the recess diameter 25D of the annular recess 24D.

In this fourth embodiment of the invention, the applicator tip 20D comprises a sheath 120D having an internal passage 122D. Preferably, the sheath 120D is formed from a rigid or a semi-rigid material such as a suitable polymeric material. The inner end 21D of the applicator tip 20D includes a plurality of voids 29D defined in the sheath 120D. The plurality of voids 29D facilitate the flow of applicator liquid 8 to the internal passage 122D of the applicator tip 20D. The outer end 22D of the applicator tip 20D includes an enlarged socket 124D and an actuator surface 126D. The enlarged socket 124D is in fluid communication with the internal passage 122D of the applicator tip 20D.

A plurality of fibers 130D are disposed within the enlarged socket 124D for forming a brush 140D. The plurality of fibers 130D may be secured within the internal passage 122D of the sheath 120D by friction, adhesives, sonic welding or any other suitable means.

Figure 25:
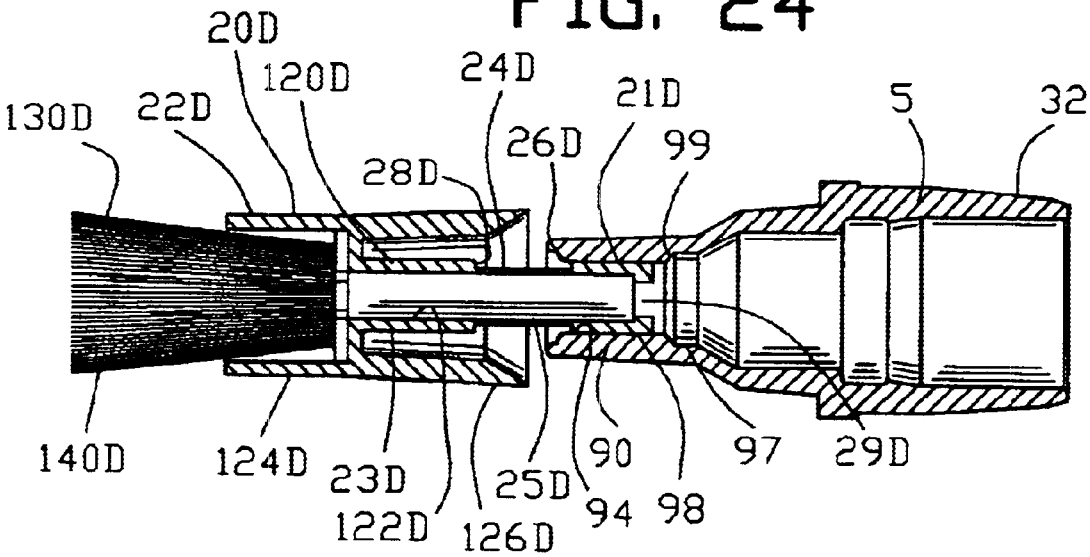
FIG. 25 is an exploded view of the applicator tip of FIG. 23 located adjacent to a portion of the liquid dispensing mechanism.

FIG. 25 is an exploded view of the applicator tip 20D of FIG. 23 located adjacent to a portion of the liquid dispensing mechanism 30. The inner end 21D of the applicator tip 20D is inserted within the passageway 94 of the closure 90. The actuator surface 126D is disposed coaxally about the closure 90.

Figure 26:
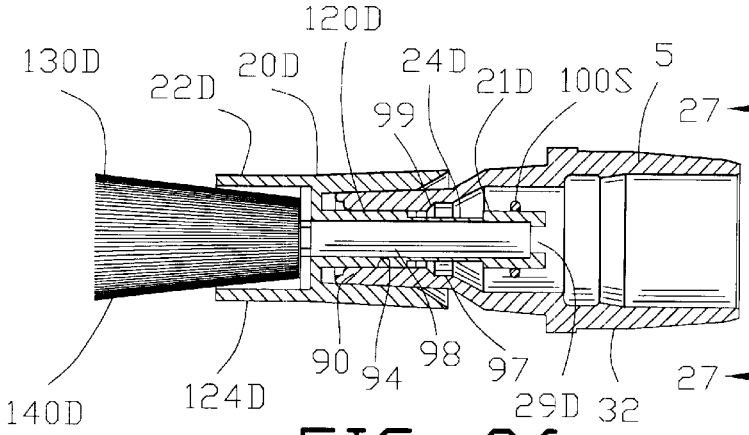
FIG. 26 is a view similar to FIG. 25 with the applicator tip inserted into the portion of the liquid dispensing mechanism.

FIG. 26 is a view similar to FIG. 25 with the applicator tip 20D inserted into the portion of the liquid dispensing mechanism 30. The retaining ring 100S has an inner diameter 101S and an outer diameter 102S and a split 104S. The inner diameter 101S is greater in diameter than the diameter 25D of the annular recess 24D and less than the cylindrical diameter 23D of the applicator tip 20D. The inner diameter 101S of the retaining ring 100S may be expanded thorough the split 104S.

Figure 27:
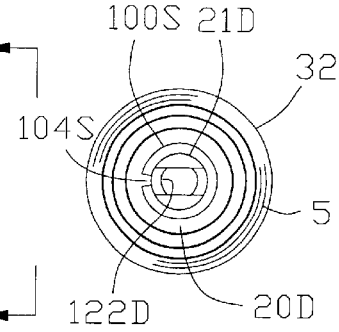
FIG. 27 is a view along line 27—27 in FIG. 26.

FIG. 27 is a view along line 27—27 in FIG. 26. The retaining ring 100S is shown expanded thorough the split 104S to increase the inner diameter 101S. The expanded retaining ring 100S is shown positioned over the inner end 21D of the applicator tip 20D. The expanded retaining ring 100S is passed over the inner end 21D of the applicator tip 20D to be positioned over the annular recess 24D of the applicator tip 20D.

Figure 28:
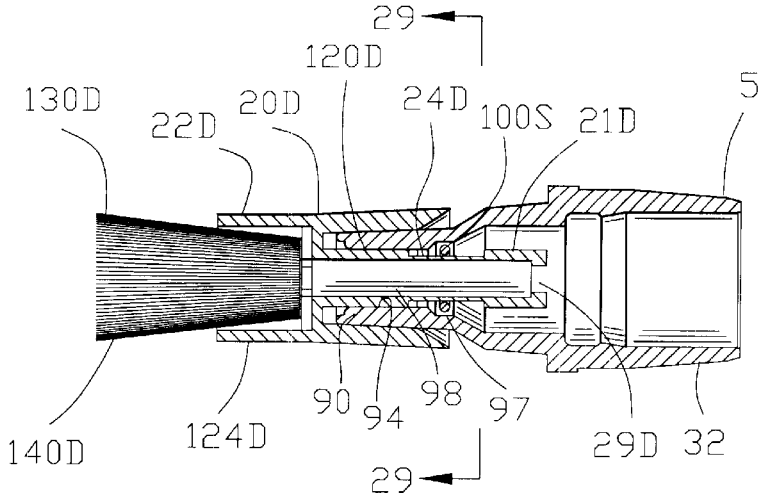
FIG. 28 is a view similar to FIG. 26 with the retainer secured to the applicator tip.

FIG. 28 is a view similar to FIG. 26 with the retainer ring 100S secured to the applicator tip 20D. When the retaining ring 100S is positioned over the annular recess 24D of the applicator tip 20D, the retaining ring 100S is released to allow the retaining ring 100S to return to the original diameter 101S.

Figure 29:
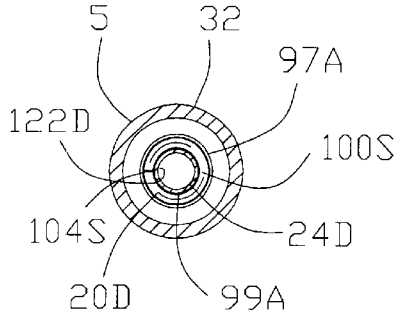
FIG. 29 is a sectional view along line 29—29 in FIG. 28.

FIG. 29 is a sectional view along line 29—29 in FIG. 28. The cylindrical diameter 23D of the applicator tip 20D forms a sliding seal with the tubular seal 80. The cylindrical diameter 23D of the applicator tip 20D is supported in a sliding engagement by the support centering ribs 98 extending from the closure 90 for enabling axial movement of the applicator tip 20D relative to the closure 90.

Figure 30:
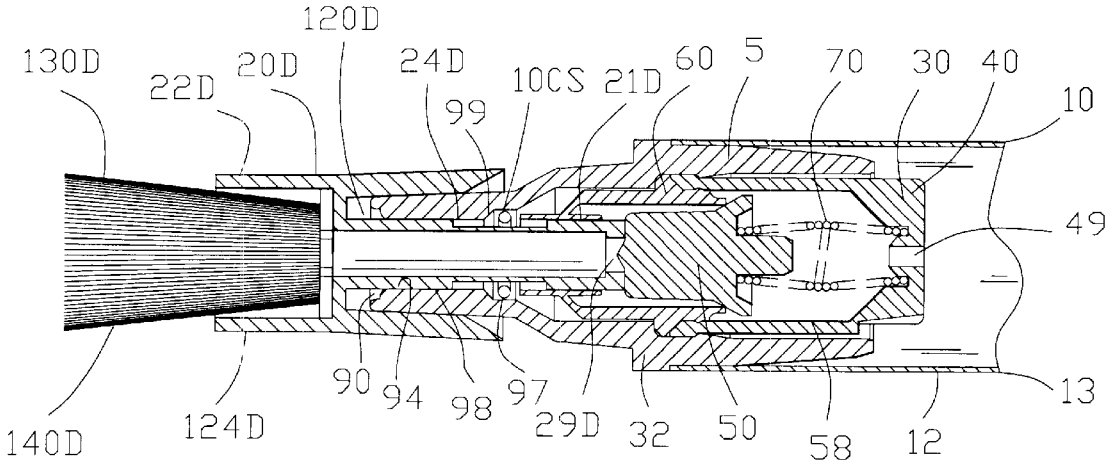
FIG. 30 is a side sectional view illustrating the fourth embodiment of the applicator tip of the present invention with the liquid dispensing mechanism being shown disposed in a closed position.

FIG. 30 is a side sectional view illustrating the fourth embodiment of the applicator tip 20D of the present invention with the liquid dispensing mechanism 30 being shown disposed in a closed position. The liquid dispensing mechanism 30 incorporates most of the components of the liquid dispensing mechanism 30 of the prior art shown in FIG. 5 which are identified by the same reference numeral.

Figure 31:
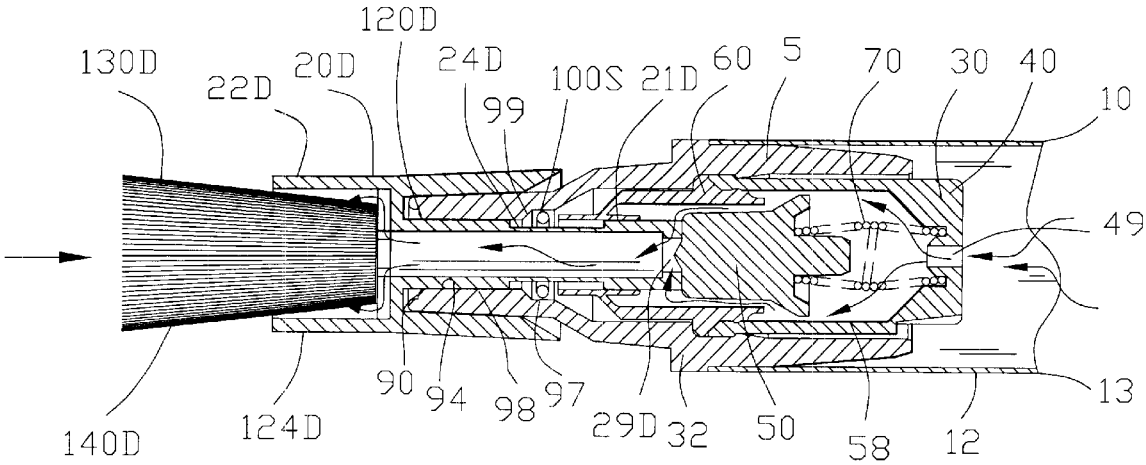
FIG. 31 is a view similar to FIG. 30 with the liquid dispensing mechanism being shown in an open position.

FIG. 31 is a view similar to FIG. 30 with the liquid dispensing mechanism 30 being shown in an open position. The liquid dispensing mechanism 30 is moved into the open position upon the depression of the applicator tip 20D. The liquid dispensing mechanism 30 is moved into the open position upon the depression of the outer end 22D of the sheath 120D of the applicator tip 20D by an operator. More specifically, an operator gasps the actuator surface 126D to depression of the outer end 22D of the sheath 120D. The rigid or semi-rigid sheath 120D enables the dispensing mechanism 30 to be moved into the open position upon the depression of the actuator surface 126D of the applicator tip 20D.

Figure 32:
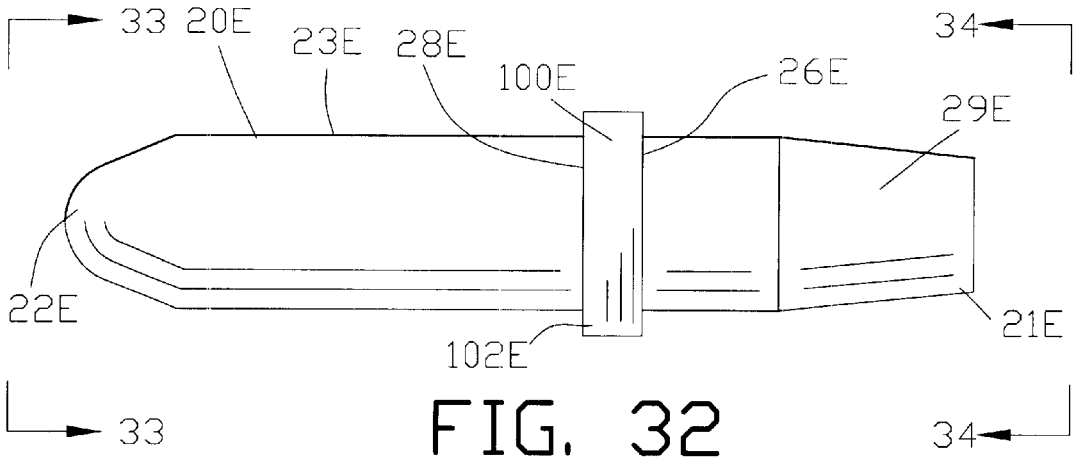
FIG. 32 is a magnified side view of a fifth embodiment of an applicator tip and a retainer of the present invention.
Figure 33:
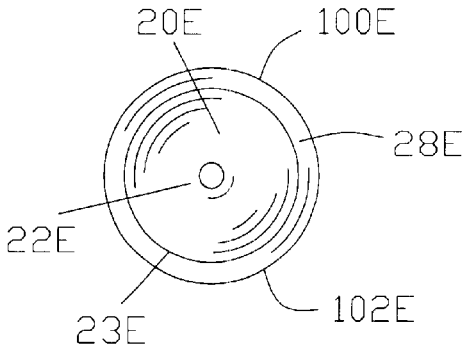
FIG. 33 is a view along line 33—33 in FIG. 32.
Figure 34:
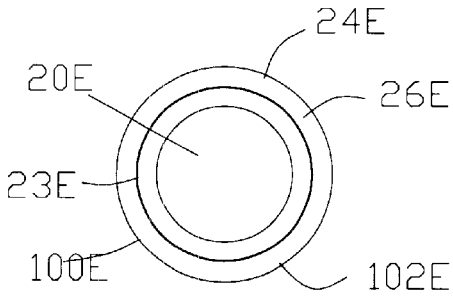
FIG. 34 is a view along line 34—34 in FIG. 32.

FIG. 32–34 are magnified views of a fifth embodiment of an applicator tip 20E and a retainer 100E of the present invention. The applicator tip 20E extends between the inner end 21E and the outer end 22E and defines a cylindrical diameter 23E. The applicator tip 20E includes a retainer 100E located intermediate the inner end 21E and the outer end 22E of the applicator tip 20E. Preferably, the retainer 100E is integrally formed with the applicator tip 20E. The annular retainer 100E defines a retainer diameter 102E. Preferably, the retainer 100E is an annular retainer 100E. The diameter 102E of the retainer 100E is greater than the cylindrical diameter 23E of the applicator tip 20E.

Figure 35:
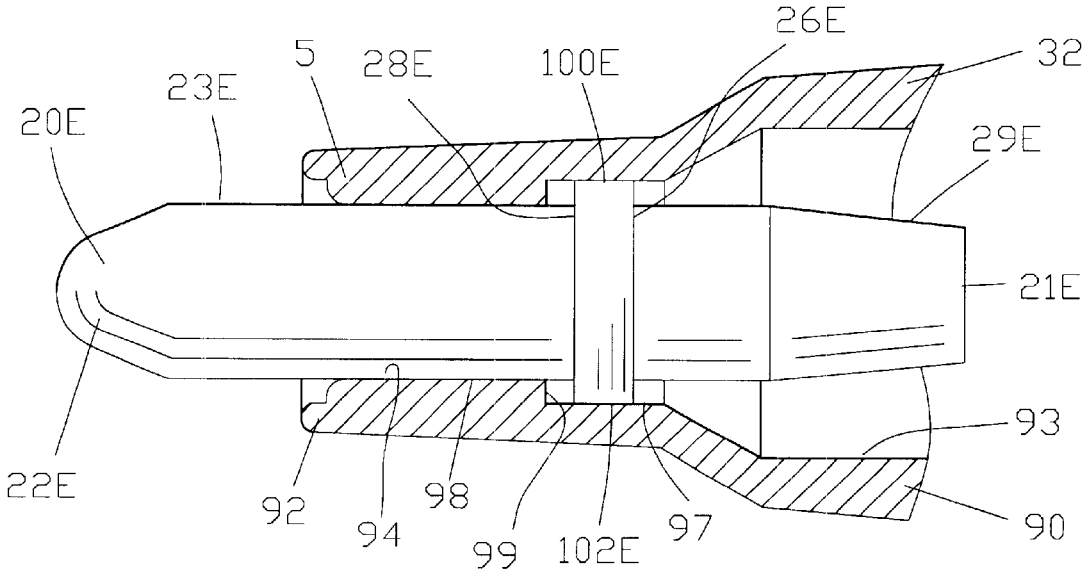
FIG. 35 is a magnified view of the retainer and applicator tip of FIG. 32 within the liquid dispensing mechanism.

FIG. 35 is a magnified view of the applicator tip 20E and the retainer 100E of FIG. 32 within the liquid dispensing mechanism 30. The inner end 21E of the applicator tip 20E is in direct engagement with the valve element outer end 52 of the valve element 50. The cylindrical diameter 23E of the applicator tip 20E forms a sliding seal with the tubular seal 80. The cylindrical diameter 23E of the applicator tip 20E is supported in a sliding engagement by the support centering ribs 98 extending from the closure 90 for enabling axial movement of the applicator tip 20E relative to the closure 90.

Figure 36:
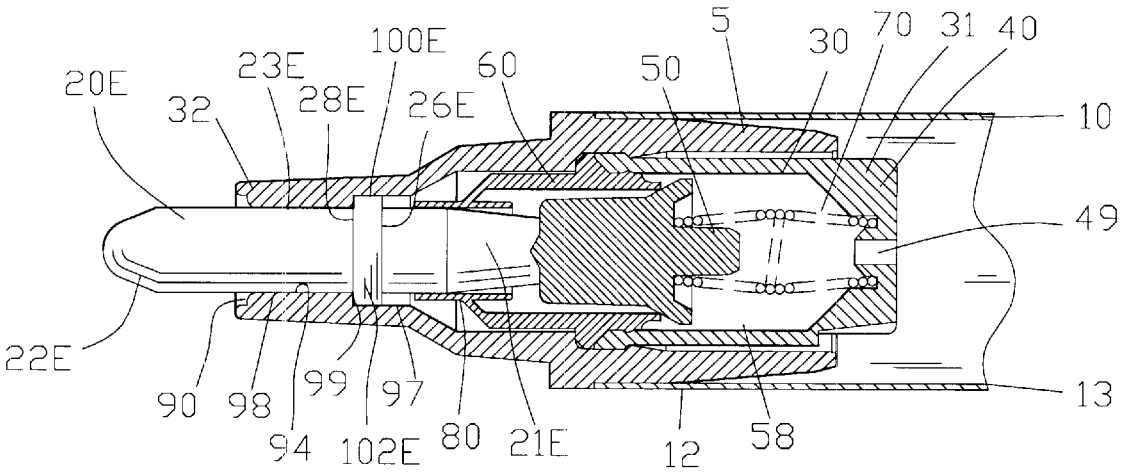
FIG. 36 is a side view illustrating the fifth embodiment of the applicator tip and the retainer of the present invention shown in FIG. 32 incorporated into a liquid dispensing mechanism shown disposed in a closed position.

FIG. 36 is a side view illustrating the fifth embodiment of the applicator tip 20E and the retainer 100E of the present invention shown in FIG. 32 incorporated into a liquid dispensing mechanism 30 shown disposed in a closed position. The hollow cylindrical respite 97 is dimensioned to receive the retainer 100E therein. The retainer 100E has an outer diameter 102E greater than the diameter of the shoulder 99 defined by the support centering ribs 98 of the closure 90. Accordingly, the retainer 100E forms an interference fit with shoulder 99 for preventing removal of the applicator tip 20E from the a liquid applicator device 5.

Figure 37:
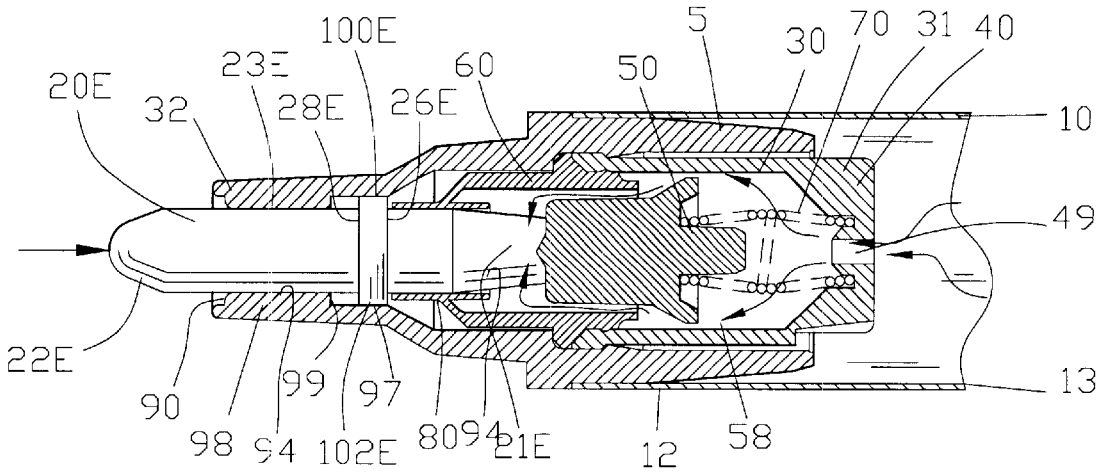
FIG. 37 is a view similar to FIG. 36 illustrating the liquid dispensing mechanism in an open position.

FIG. 37 is a view similar to FIG. 36 illustrating the liquid dispensing mechanism 30 being shown in an open position. The liquid dispensing mechanism 30 is moved into the open position upon the depression of the applicator tip 20E by the surface 110. More specifically, the liquid dispensing mechanism 30 is moved into the open position upon the depression of the outer end 22E of the applicator tip 20E by the surface 110.

In an alternative to this embodiment of the invention, the annular retainer 100E may extend to the inner end 21E. The retainer diameter 102E of the annular retainer 100E extends to the inner end 21E and forms a sliding seal with an enlarged tubular seal 80. The cylindrical diameter 23E of the outer end 22E of the applicator tip 20E is supported in a sliding engagement by the support centering ribs 98 extending from the closure 90 for enabling axial movement of the applicator tip 20E relative to the closure 90. Preferably, the retainer 100E is integrally formed with the applicator tip 20E.

Figure 38:
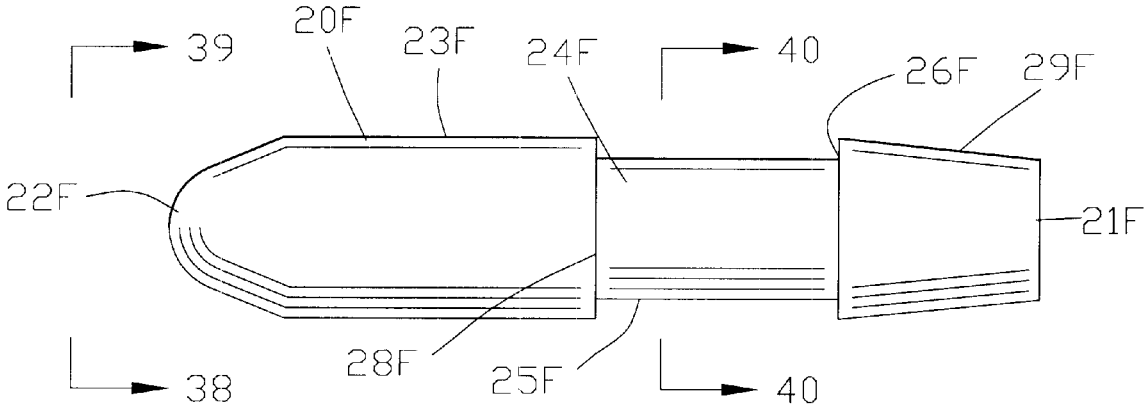
FIG. 38 is a magnified side view of a sixth embodiment of an applicator tip of the present invention.
Figure 39:
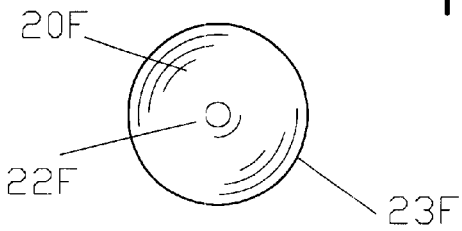
FIG. 39 is a view along line 39—39 in FIG. 38.
Figure 40:
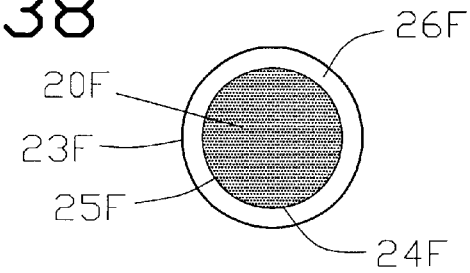
FIG. 40 is a sectional view along line 40—40 in FIG. 38.

FIGS. 38–40 are magnified views of a sixth embodiment of an applicator tip 20F of the present invention. The applicator tip 20F extends between the inner end 21F and the outer end 22F and defines a cylindrical diameter 23F. The applicator tip 20F includes an annular recess 24F located intermediate the inner end 21F and the outer end 22F of the applicator tip 20F. The annular recess 24F defines a recess diameter 25F extending between an inner shoulder 26F and an outer shoulder 28F. The cylindrical diameter 23F of the applicator tip 20F is greater than the recess diameter 25F of the annular recess 24F.

Figure 41:
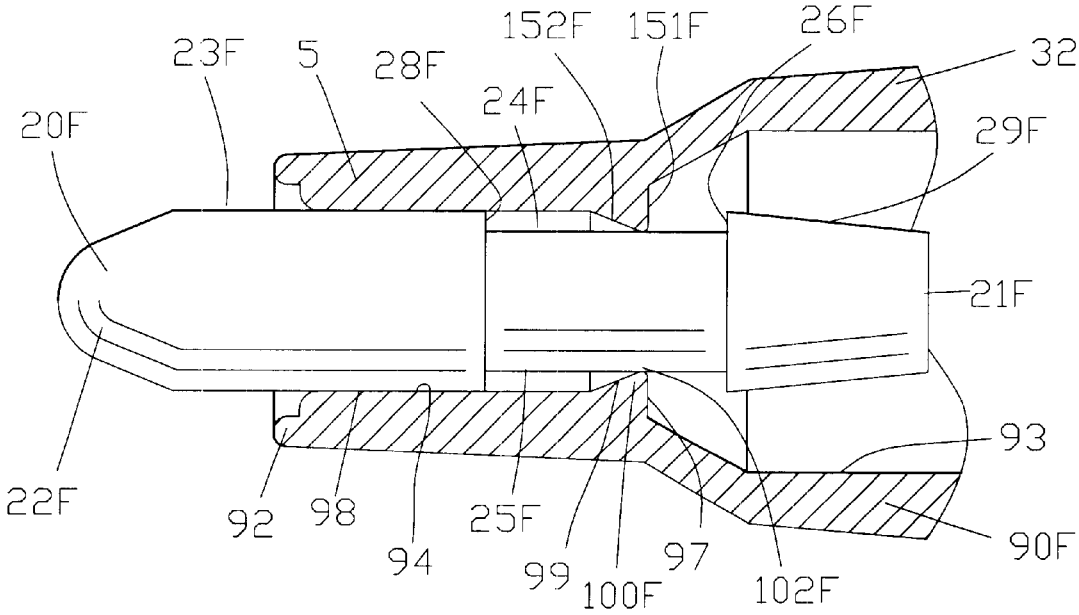
FIG. 41 is a magnified view of the applicator tip of FIG. 38 within the liquid dispensing mechanism.

FIG. 41 is a magnified view of the applicator tip 20F of FIG. 38 within the liquid dispensing mechanism 30. The inner end 21F of the applicator tip 20F is in direct engagement with the valve element outer end 52 of the valve element 50. The cylindrical diameter 23F of the applicator tip 20F forms a sliding seal with the tubular seal 80. The cylindrical diameter 23F of the applicator tip 20F is supported in a sliding engagement by the support centering ribs 98 extending from the closure 90F for enabling axial movement of the applicator tip 20F relative to the closure 90F.

In this embodiment of the invention, the retainer 100F extends inwardly from the closure 90F. Preferably, the retainer 100F is integrally formed with the closure 90F. In this example of the invention, the retainer 100F is an annular retainer 100F. The annular retainer 100F extends inwardly from the closure 90F to define a retainer diameter 102F. The diameter 102F of the retainer 100F is greater than the recess diameter 25F of the annular recess 24F. The diameter 102F of the retainer 100F is less than the cylindrical diameter 23F of the applicator tip 20F for forming an interference fit with shoulder 99 for preventing removal of the applicator tip 20F from the a liquid applicator device 5.

The retainer 100F extends angularly from the closure 90F. The retainer 100F includes a normal surface 151F and a ramp surface 152F. The normal surface 151F extends generally perpendicular to the direction of movement of the applicator tip 20F. The ramp surface 152F extends angularly relative to the direction of movement of the applicator tip 20F.

The ramp surface 152F is oriented in an opposite direction to the direction of the taper 29F of the inner end 21F of the applicator tip 20F. The ramp surface 152F cooperates with the taper 29F of the inner end 21F of the applicator tip 20F for facilitating the insertion of the applicator tip 20F into the outer end 92 of the closure 90F. The ramp surface 152F of the retainer 100F compresses the inner end 21F of the applicator tip 20F for enabling the retainer 100F to enter the annular recess 24F of the applicator tip 20F.

Figure 42:
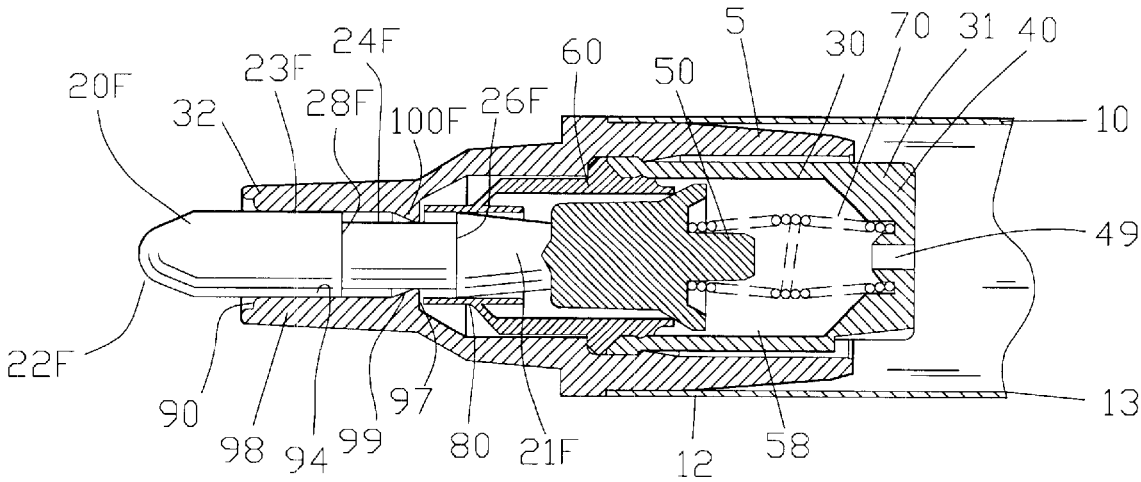
FIG. 42 is a side view illustrating the sixth embodiment of the present invention of FIG. 38 incorporated into a liquid dispensing mechanism shown disposed in a closed position.

FIG. 42 is a side sectional view illustrating the sixth embodiment of the applicator tip 20F of the present invention incorporated within the liquid dispensing mechanism 30 being shown disposed in a closed position. The liquid dispensing mechanism 30 incorporates most of the components of the liquid dispensing mechanism 30 of the prior art shown in FIG. 5 which are identified by the same reference numeral.

Figure 43:
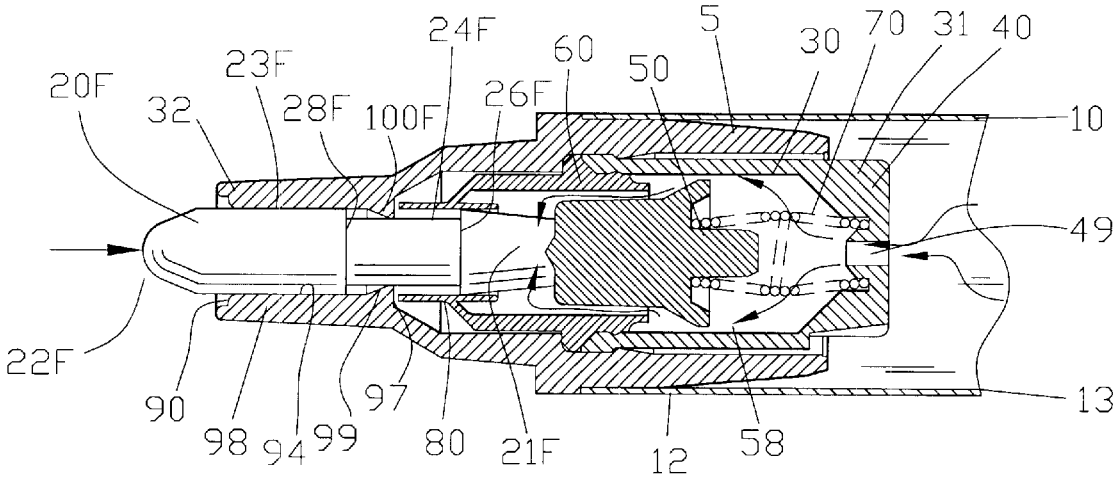
FIG. 43 is a view similar to FIG. 42 illustrating the liquid dispensing mechanism in an open position.

FIG. 43 is a view similar to FIG. 42 illustrating the liquid dispensing mechanism 30 in an open position. The liquid dispensing mechanism 30 is moved into the open position upon the depression of the applicator tip 20F by the surface 110. More specifically, the liquid dispensing mechanism 30 is moved into the open position upon the depression of the outer end 22F of the applicator tip 20F by the surface 110.

The present invention provides an improved applicator tip for a liquid applicator device for dispensing an applicator liquid that ensures improved retention of an applicator tip of the liquid dispensing device. The improved applicator tip may be utilized without altering the dispensing mechanism of the prior art. The improved applicator tip does not increase the cost of the dispensing mechanism of liquid applicator device.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. In a liquid applicator device comprising an applicator liquid container and a liquid dispensing mechanism having a valve being movable between an open position and a closed position for controlling the flow of applicator liquid from the container, the applicator liquid dispensing mechanism having a support portion for supporting an applicator tip communicating with the valve for permitting the flow of applicator liquid from the container to the applicator tip upon movement of the valve into the open position for applying the applicator liquid, the improvement comprising:

said applicator tip having a recess;

a generally toroidal retaining ring;

said retaining ring disposed in said recess of the applicator tip; and said recess cooperating with said retaining ring for preventing removal of the applicator tip from the liquid applicator device.

2. The liquid applicator device as set forth in claim 1, wherein said recess is defined in said applicator tip with said retaining ring cooperating with said support portion.

3. The liquid applicator device as set forth in claim 1, wherein said retaining ring extends into said recess for forming an interference fit to prevent removal of the applicator tip from the liquid applicator device.

4. The liquid applicator device as set forth in claim 1, wherein said retaining ring is slidably disposed in said recess defined in the applicator tip.

5. In a liquid applicator device comprising an applicator liquid container and a liquid dispensing mechanism having a valve element being movable between an open position and a closed position for controlling the flow of applicator liquid from the container, the applicator liquid dispensing mechanism having a hollow cylindrical respite for supporting an applicator tip with an inner end of the applicator tip communicating with the valve element for permitting the flow of applicator liquid from the container to the inner end of the applicator tip upon an axial displacement of the applicator tip to move the valve element into the open position for enabling the applicator liquid to migrate to an outer end of the applicator tip for applying the liquid to a surface, the improvement comprising:

a recess defined in said applicator tip;

a generally toroidal retaining ring;

said generally toroidal retaining ring disposed in said recess of said applicator tip; and said retaining ring cooperating with said recess for preventing removal of the applicator tip from the a liquid applicator device.

6. In a liquid applicator device comprising an applicator liquid container and a liquid dispensing mechanism having a valve element being movable between an open position and a closed position for controlling the flow of applicator liquid from the container, the applicator liquid dispensing mechanism having a hollow cylindrical respite for supporting an applicator tip with an inner end of the applicator tip communicating with the valve element for permitting the flow of applicator liquid from the container to the inner end of the applicator tip upon an axial displacement of the applicator tip to move the valve element into the open position for enabling the applicator liquid to migrate to an outer end of the applicator tip for applying the liquid to a surface, the improvement comprising:

said applicator tip having an annular recess disposed between said outer end and said inner end;

a generally toroidal retaining ring;

said retaining ring being slideably disposed within said annular recess with said retaining ring forming an interference fit with said annular recess of the applicator tip for limiting movement of said retaining ring only within said annular recess; and said retaining ring forming an interference fit with the hollow cylindrical respite for preventing removal of the applicator tip from the liquid applicator device.

7. The liquid applicator device as set forth in claim 6, including a shoulder being disposed on said hollow cylindrical respite for receiving said retaining ring disposed in said annular recess of the applicator tip.

8. The liquid applicator device as set forth in claim 6, wherein the applicator tip comprises a substantially flexible applicator tip.

9. The liquid applicator device as set forth in claim 6, wherein the applicator tip comprises a substantially rigid applicator tip.

10. The liquid applicator device as set forth in claim 6, wherein the applicator tip is a substantially cylindrical applicator tip having a first diameter with said annular recess having a second diameter disposed between said outer end and said inner end; and said annular recess extending along at least one-quarter of a cylindrical length of said cylindrical applicator tip.

11. The liquid applicator device as set forth in claim 6, wherein the applicator tip is a substantially cylindrical applicator tip having a first diameter with said annular recess having a second diameter disposed between said outer end and said inner end;

said first diameter of said cylindrical applicator tip being greater than said second diameter of said annular recess;

said retaining ring being disposed in said annular recess of said applicator tip;

said retaining ring having an inner diameter greater than said second diameter of said annular recess and less than said first diameter of said cylindrical applicator tip for enabling said retaining ring to be slidably retained within said annular recess; and said retaining ring having an outer diameter greater than said first diameter of said cylindrical applicator tip for engaging a shoulder disposed on said hollow cylindrical respite for preventing removal of the applicator tip from the a liquid applicator device.

12. The liquid applicator device as set forth in claim 6, wherein said retaining ring is a metallic retaining ring.

13. In a liquid applicator device comprising an applicator liquid container and a liquid dispensing mechanism, the liquid dispensing mechanism comprising an inner and an outer assembly, the inner assembly having a valve body receivable in an open end of the container with a valve element positioned within said valve body biased into engagement with a valve seal; the outer assembly including a hollow cylindrical respite for supporting an applicator tip with an inner end of the applicator tip communicating with the valve element for permitting the flow of applicator liquid from the container to the inner end of the applicator tip upon an axial displacement of the applicator tip to move the valve element out of engagement with the valve seal for enabling the applicator liquid to migrate to an outer end of the applicator tip for applying the liquid to a surface, the improvement comprising:

the applicator tip having an annular recess disposed between said outer end and said inner end;

a generally toroidal retaining ring disposed in said annular recess of said applicator tip;

a hollow cylindrical closure having a shoulder disposed thereon for receiving said retaining ring disposed on said applicator tip;

the outer assembly being securable to the inner assembly for entrapping the retaining ring disposed in said annular recess between the outer and the inner assemblies for preventing the removal of the applicator tip from the liquid applicator device.

14. The liquid applicator device as set forth in claim 13, wherein the applicator tip comprises a substantially flexible applicator tip.

15. The liquid applicator device as set forth in claim 13, wherein the applicator tip comprises a substantially rigid applicator tip.

16. The liquid applicator device as set forth in claim 13, wherein the inner end of the applicator tip comprises a tapered portion for facilitating the flow of liquid to the inner end of the applicator tip.

17. The liquid applicator device as set forth in claim 13, wherein the applicator tip is made from a porous material for enabling the liquid to migrate from the inner end to the outer end of the applicator tip for applying the liquid to the surface.

18. The liquid applicator device as set forth in claim 13, wherein the applicator tip is a substantially cylindrical applicator tip having a first diameter with said annular recess having a second diameter disposed between said outer end and said inner end; and said annular recess extending along at least one-quarter of a cylindrical length of said cylindrical applicator tip.

19. The liquid applicator device as set forth in claim 13, wherein the applicator tip is a substantially cylindrical applicator tip having a first diameter with said annular recess having a second diameter disposed between said outer end and said inner end;

said first diameter of said cylindrical applicator tip being greater than said second diameter of said annular recess;

said retaining ring being disposed in said annular recess of said applicator tip;

said retaining ring having an inner diameter greater than said second diameter of said annular recess and less than said first diameter of said cylindrical applicator tip for enabling said retaining ring to be slidably retained within said annular recess; and said retaining ring having an outer diameter greater than said first diameter of said cylindrical applicator tip for engaging a shoulder disposed on said hollow cylindrical respite for preventing removal of the applicator tip from the liquid applicator device.

20. The liquid applicator device as set forth in claim 13, wherein said retaining ring is a metallic retaining ring.

21. In a liquid applicator device comprising an applicator liquid container and a liquid dispensing mechanism having a valve being movable between an open position and a closed position for controlling the flow of applicator liquid from the container, the liquid dispensing mechanism having a support portion for supporting an applicator tip communicating with the valve for permitting the flow of applicator liquid from the container to the applicator tip upon movement of the valve into the open position for applying the applicator liquid, the improvement comprising:

said applicator tip having a recess extending between an inner shoulder and an outer shoulder;

a retaining ring;

said retaining ring defining an inner diameter and an outer diameter;

said retaining ring being disposed for movement within said recess of said applicator tip;

said retaining ring being disposed for movement within a respite defined in the liquid dispensing mechanism;

said inner diameter forming an interference fit with said inner and outer shoulders of said recess for limiting the independent movement of said retaining ring within said annular recess;

said outer diameter of said retaining ring forming an interference fit with said respite defined in the liquid dispensing mechanism for limiting the movement of said retaining ring within said respite; and said interference fit of said inner diameter cooperating with said interference fit of said outer diameter for preventing removal of the applicator tip from the liquid applicator device.

22. In a liquid applicator device comprising an applicator liquid container and a liquid dispensing mechanism having a valve being movable between an open position and a closed position for controlling the flow of applicator liquid from the container, the liquid dispensing mechanism having a support portion for supporting an applicator tip communicating with the valve for permitting the flow of applicator liquid from the container to the applicator tip upon movement of the valve into the open position for applying the applicator liquid, the improvement comprising:

said applicator tip having a recess;

a retaining ring moveably retained in said recess of said applicator tip;

a respite defined by the liquid dispensing mechanism; and said retaining ring simultaneously engaging with said recess and with said respite for preventing removal of said applicator tip from the liquid applicator device.

23. In a liquid applicator device comprising an applicator liquid container and a liquid dispensing mechanism having a valve element being movable between an open position and a closed position for controlling the flow of applicator liquid from the container, the liquid dispensing mechanism having a hollow cylindrical respite for supporting an applicator tip with an inner end of the applicator tip communicating with the valve element for permitting the flow of applicator liquid from the container to the inner end of the applicator tip upon an axial displacement of the applicator tip to move the valve element into the open position for enabling the applicator liquid to migrate to an outer end of the applicator tip for applying the liquid to a surface, the improvement comprising:

a recess defined in said applicator tip;

a retaining ring being moveably retained within said recess of said applicator tip;

said retaining ring being moveably retained by a respite of the liquid dispensing mechanism; and said retaining ring cooperating with said recess and said respite of liquid dispensing mechanism for preventing removal of said applicator tip from the liquid applicator device.

* * * * *